US006715855B2

(12) United States Patent
Oda et al.

(10) Patent No.: US 6,715,855 B2
(45) Date of Patent: Apr. 6, 2004

(54) INK JET RECORDING DEVICE AND BUBBLE REMOVING METHOD

(75) Inventors: Kazuyuki Oda, Ebina (JP); Takayuki Takeuchi, Ebina (JP); Kenji Ikeda, Ebina (JP); Takeshi Yoneyama, Ebina (JP); Masahiko Fujii, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/101,390

(22) Filed: Mar. 20, 2002

(65) Prior Publication Data

US 2003/0001927 A1 Jan. 2, 2003

(30) Foreign Application Priority Data

May 23, 2001 (JP) ..... 2001-154492

(51) Int. Cl.[7] ..... B41J 2/165

(52) U.S. Cl. ..... 347/35; 347/29; 347/30; 347/92

(58) Field of Search ..... 347/35, 9, 10, 347/11, 14, 17, 29, 30, 33, 23, 47.6, 61.65, 92

(56) References Cited

U.S. PATENT DOCUMENTS

| | | | | | |
|---|---|---|---|---|---|
| 5,132,707 | A | * | 7/1992 | O'Neill | 347/65 |
| 5,479,196 | A | * | 12/1995 | Inada | 347/92 |
| 5,493,319 | A | * | 2/1996 | Hirabayashi et al. | 347/29 |
| 5,793,388 | A | * | 8/1998 | Martinson et al. | 347/19 |
| 5,805,186 | A | * | 9/1998 | Yoshida et al. | 347/61 |
| 6,095,633 | A | * | 8/2000 | Harsbarger et al. | 347/30 |
| 6,543,876 | B2 | * | 4/2003 | Kotaki | 347/30 |

FOREIGN PATENT DOCUMENTS

| | | |
|---|---|---|
| JP | A 62-211150 | 9/1987 |
| JP | A 63-53047 | 3/1988 |
| JP | A 63-224958 | 9/1988 |
| JP | A 2-78567 | 3/1990 |
| JP | A 4-219253 | 8/1992 |
| JP | A 4-363253 | 12/1992 |
| JP | A 5-155035 | 6/1993 |
| JP | A 5-229138 | 9/1993 |
| JP | A 7-186402 | 7/1995 |
| JP | A 7-195711 | 8/1995 |
| JP | A 8-58095 | 3/1996 |
| JP | A 8-169124 | 7/1996 |
| JP | A 2001-38925 | 2/2001 |

* cited by examiner

*Primary Examiner*—Shih-Wen Hsieh
(74) *Attorney, Agent, or Firm*—Oliff & Berridge, PLC

(57) ABSTRACT

Heating elements are driven to continuously perform a dummy jet when the number of accumulated printed sheets reaches a predetermined number that causes the image quality deficiency. The surface temperature of a recording head is increased to T1° C. to boil ink in the individual channel. A bubble attached to the common liquid chamber side edge of the individual channel is spaced from the wall surface to be expanded to be integrated with other bubbles, and then, is discharged from the common liquid chamber to an ink supply chamber by its floating force. The bubble can be removed reliably.

18 Claims, 14 Drawing Sheets

INK JET RECORDING DEVICE AND BUBBLE REMOVING METHOD

BACKGROUND OF THE INVENTION

1. Field of the Invention

The present invention relates to an ink jet recording device and a bubble removing method.

2. Description of the Related Art

In an ink jet recording head mounted on the carriage of an ink jet recording device, a measure to image quality deficiency due to a bubble (ink droplet non-discharge) has been taken.

Image quality deficiency due to a bubble is caused in such a manner that a bubble larger than the cross-sectional size of an individual channel is attached to a portion for opening the edge of the individual channel in a common liquid chamber to clog the opening portion, resulting in inhibition of ink supply.

To remove the bubble, typically, an ink discharge opening is capped for negative-pressure suction so as to be discharged outside together with ink in the recording head.

Other than the ink discharge opening for printing, also typical is a method in which several to several tens of large dummy nozzles are provided to suction ink from the dummy nozzles, thereby suctioning and removing a bubble in the recording head.

To recover image quality deficiency due to a bubble produced in the recording head with respect to the related art, various proposals have been made. Some examples will be described hereinbelow.

Japanese Published Unexamined Patent Application No. Sho 63-224958 (hereinafter, referred to as related art 1) discloses that an elastic cap is pressed against an ink discharge opening to increase the internal pressure which is released into the atmosphere, and then, a suction recovery operation is performed.

Japanese Published Unexamined Patent Application No. Hei 2-78567 (hereinafter, referred to as related art 2) disclose that a pressurizing heater is provided aside from a recording heater, and the pressurizing heater can provide a dummy jet to reduce the ink consumption for discharge recovery, thereby shortening the recovering time.

Japanese Published Unexamined Patent Application No. Hei 4-219253 (hereinafter, referred to as a related art 3) discloses that a heater of an ink discharge opening adjacent to the ink discharge opening for discharge recovery is driven to discharge a bubble.

Japanese Published Unexamined Patent Application No. Hei 4-363253 (hereinafter, referred to as related art 4) discloses that in a recovery mode, an energy 1.48 times or more larger than a minimum energy which can form a bubble to perform ink discharge is supplied to perform preliminary discharge 1000 times or more.

Japanese Published Unexamined Patent Application No. Hei 5-155035 (hereinafter, referred to as related art 5) discloses that when a bubble is small and is diffused into ink within a predetermined time, printing is stopped corresponding to the diffusion time in ink.

Japanese Published Unexamined Patent Application No. Hei 7-195711 (hereinafter, referred to as related art 6) discloses that a bubble producing heater is provided aside from a recording heater, wherein a produced bubble and remaining bubbles are integrated to be suctioned reliably.

Japanese Published Unexamined Patent Application No. Hei 8-58095 (hereinafter, referred to as related art 7) discloses that an ink channel section between a recording head and an ink reservoir part is of a shape in which at least 90% of the entire length defines a circle having a diameter below 1 mm as a circumcircle so as to increase the flow velocity of the ink channel, thereby reliably removing a bubble when ink is suctioned.

Japanese Published Unexamined Patent Application No. Hei 8-169124 (hereinafter, referred to as related art 8) discloses that a discharge signal having a frequency higher than that of a discharge signal at recording is added at a recover operation, and then, suction is performed for recovery.

The following measures have been taken to the ink jet recording device in order to prevent nozzle clogging due to printing stop or permit recovery from clogging.

Japanese Published Unexamined Patent Application No. Sho 62-211150 (hereinafter, referred to as related art 9) discloses that pressurizing ink is supplied to an ink supply passage to flow the ink from a nozzle, thereby eliminating ink clogging and removing a bubble.

Japanese Published Unexamined Patent Application No. Sho 63-53047 (hereinafter, referred to as related art 10) discloses that a nozzle and a reciprocating pump are communicated to each other to perform a suction operation, thereby suctioning ink from the nozzle for a recovery operation.

Japanese Published Unexamined Patent Application No. Hei 5-229138 (hereinafter, referred to as related art 11) discloses an ink jet recording device using conductive ink, wherein when ink non-discharge is detected, the voltage of an ink discharge power source is increased to recover ink non-discharge.

Japanese Published Unexamined Patent Application No. Hei 7-186402 (hereinafter, referred to as related art 12) discloses that a nozzle part is brought into contact with a cap to be driven in a closed state so as to permit head temperature rise and recovery without wasting ink.

Japanese Published Unexamined Patent Application No. 2001-38925 (hereinafter, referred to as related art 13) discloses that a capping unit has a suction opening and a suction pump disposed in at least two spaced positions, allowing a closed valve to be in an open state while the upstream side valve of a recording head is opened and driving the suction pump selectively or simultaneously.

The related art for removing a bubble by negative-pressure suction including the related arts 1 and 6 to 8 has the following disadvantages.

Since the suction unit is necessary, the mechanism is complicated and the waste ink amount is increased.

To realize highly fine image quality such as a picture, a recording head for discharging a small amount of ink droplet is necessary. In such a recording head, the section of the ink discharge opening and the individual channel is a circle having a diameter of about several $\mu$m to several tens of $\mu$m or a rectangle having one side of about several $\mu$m to several tens of $\mu$m.

The cross-sectional area of the individual channel is reduced to increase the channel resistance. Unless the negative-pressure suction force is increased considerably, an ink flow velocity enough to suction and remove a bubble from the recording head cannot be obtained.

The related art for removing a bubble by the dummy nozzles has the following disadvantages.

The recording head is larger since the ink discharge opening not contributing to printing is formed. When the negative pressure in the recording head is high, a bubble is suctioned into the common liquid chamber from the ink discharge opening for the dummy nozzle with a large cross-sectional area.

The construction of the related art 2 has the disadvantage that the pressurizing heater is necessary so that the device is complicated.

In the construction of the related art 3, it is difficult to detect the ink discharge opening (individual channel) for discharge recovery, and more bubbles may be suctioned into the head from the ink discharge opening recovered by ink discharge from the adjacent ink discharge opening.

In the construction of the related art 4, since the heater is driven by an excessive energy as compared with ink discharge for normal printing, there arises the problem in the reliability of the electric circuit and the life of the heater.

In the construction of the related art 5, since printing is stopped together with bubble production, the printing processing ability is lowered.

The related art for preventing clogging has the following disadvantages.

In the construction of the related art 9, since the pressurizing unit is necessary, the device is larger and the device cost is increased. Ink can be leaked from the ink supply passage connection part by pressure at pressurization.

In the construction of the related art 10, a pump and solenoid are necessary for a suction operation. The device is larger and the device cost is increased.

In the construction of the related art 11, the power source cost is increased in order to vary the source voltage and there is a problem in reliability since clogging cannot be often eliminated though the voltage is increased.

In the construction of the related art 12, it is actually difficult to completely close all nozzles by a cap. Foreign particles attached to the cap member are attached to the nozzle. The cap is damaged by heat. There is a significant problem in reliability.

In the construction of the related art 13, plural suction pumps are necessary so that the device is larger and the device cost is increased. The waste ink amount not contributing to printing is large.

SUMMARY OF THE INVENTION

To eliminate the above disadvantages, the present invention provides an ink jet recording device and a bubble removing method which can prevent image deficiency by a simplified construction.

According to an aspect of the present invention, an ink jet recording device has: an ink jet recording head provided with a common liquid chamber to which ink is supplied from outside, individual channels communicated to the common liquid chamber each having an ink discharge opening formed in a front end thereof, and heating elements disposed in the individual channels discharging an ink droplet by heating ink; and a driving unit which applies a driving energy to the heating elements until ink present in the common liquid chamber is boiled.

A bubble produced in the common liquid chamber by a printing operation grows by the printing operation to clog the individual channel side edge of the common liquid chamber. Ink supply to the individual channel can be inhibited, resulting in possible image quality deficiency.

The driving unit drives the heating elements until a bubble is escaped from the common liquid chamber to the ink supply side. Ink in the common liquid chamber is boiled. The ink surface tension is lowered. The attaching force of the bubble to the wall surface is reduced. The bubble is expanded to increase the floating force. The bubble is spaced from the individual channel side edge of the common liquid chamber. The heating elements are used to boil ink so that the image quality deficiency can be recovered.

The driving unit may apply an ink discharging energy to the heating elements to continuously perform non-printing ink droplet discharge, thereby boiling ink.

In this case, the ink refill of the individual channel cannot cover the discharged ink due to the ink temperature rise. The ink meniscus position is backed to the common liquid chamber side edge of the individual channel.

As a result, the heating elements are driven in no ink state to increase the temperature. Ink in the common liquid chamber is boiled. The ink surface tension is lowered in the individual channel edge of the common liquid chamber. The bubble is expanded to increase the floating force. The bubble is spaced from the individual channel side edge of the common liquid chamber. The image quality deficiency can be recovered.

The driving unit may apply an energy smaller than the ink discharging energy for heating the recording head without discharging ink to the heating elements to boil ink.

In this case, no ink droplets are discharged from the ink discharge opening. In this state, the heating elements are driven until ink in the common liquid chamber is boiled. The ink surface tension is lowered due to the ink temperature rise. The attaching force of the bubble to the wall surface is reduced. The bubble is expanded to increase the floating force. The bubble is spaced from the individual channel side edge of the common liquid chamber. The image quality deficiency can be recovered. In addition, since ink discharge is not performed in order to boil ink, the waste ink amount by bubble removal can be reduced.

The ink jet recording device may further have a temperature detection unit which detects a temperature of the recording head. The temperature detection unit detects that the temperature of the recording head reaches a set boiling temperature, whereby the driving unit stops applying the driving energy to the heating elements. Ink in the common liquid chamber can be boiled reliably.

In this case, the set boiling temperature may be equal to or above an ink boiling point.

In general, when the temperature of the recording head is equal to or above the set boiling temperature, the ink temperature in the common liquid chamber in the recording head becomes equal to or above the boiling point to boil ink. The heating elements are driven until the temperature of the recording head reaches the set boiling temperature so as to remove a bubble clogging the individual channel side edge of the common liquid chamber.

The ink boiling point may be about 100° C.

In the case of an aqueous ink, the boiling point is about 100° C. The heating elements are driven until the temperature of the recording head reaches about 100° C. Ink in the common liquid chamber can be boiled reliably. A bubble clogging the individual channel side edge of the common liquid chamber can be removed.

After detecting that the temperature of the recording head reaches the set boiling temperature, the temperature detection unit may detect that the temperature of the recording head is lowered to a set cooling temperature, whereby the driving unit applies an ink discharging energy to the heating elements to perform non-printing ink droplet discharge.

After ink is boiled, the ink is cooled to be thickened. When the decomposed (thickened) ink is present in the recording head, it leads to clogging and deterioration of printing performance. In the present invention, when ink in the common liquid chamber is boiled, an ink discharging energy is applied to the heating elements after cooling the ink to the set cooling temperature. Thereby the thickened ink is discharged to the outside. The set cooling temperature is a temperature at which the ink meniscus position moved to the common liquid chamber side by boiling returns to a predetermined position, that is, the temperature at which the ink can be discharged.

The set boiling temperature may be a temperature at which ink refill cannot cover the discharged ink and an ink meniscus position formed in the individual channel is formed on the common liquid chamber side rather than the heating element.

When the heating elements are used continuously, the ink refill cannot cover the discharged ink due to the ink temperature rise and the ink meniscus is moved to the common liquid chamber side edge of the individual channel. As a result, the high temperature ink reaches near the common liquid chamber side edge of the individual channel. A bubble attached to the individual channel side edge of the common liquid chamber can be removed.

A cross-sectional area of the common liquid chamber side edge of the individual channel may be smaller than that of a portion where the heating element is disposed.

When the driving unit drives the heating elements to discharge an ink droplet from the ink discharge opening, the cross-sectional area of the common liquid chamber side edge of the individual channel is larger than that of a portion where the heating element is disposed. The bubble point pressure is sufficiently high. When the ink meniscus is positioned at the common liquid chamber side edge of the individual channel, it is possible to prevent air from being suctioned into the common liquid chamber due to the negative pressure of the ink supply system.

The ink jet recording device may further have an ink supply chamber provided adjacent to the common liquid chamber in order to supply ink to the common liquid chamber having a volume in which an expanded bubble can be spaced from the common liquid chamber.

A bubble attached to the individual channel side edge of the common liquid chamber is expanded by the ink temperature rise and spaced from the edge. When the channel for supplying ink into the common liquid chamber is narrow, the expanded bubble can clog the channel to affect ink supply. The ink supply chamber provided adjacent to the common liquid chamber has a volume which can space the expanded bubble from the common liquid chamber. The bubble can be reliably spaced from the common liquid chamber so as to reduce the possibility to affect the ink supply.

The ink jet recording device may further have a detection unit which detects a number of printed sheets. When the number of printed sheets reaches a predetermined number of sheets, the driving unit drives the heating element, whereby a temperature of the recording head becomes equal to or above the set temperature.

In the common liquid chamber, the bubble is increased with printing. The temperature of the recording head becomes equal to or above the set boiling temperature for each predetermined number of sheets smaller than the number of printed sheets in which the bubble clogs the individual channel side edge of the common liquid chamber to cause image quality deficiency. The bubble is removed from the common liquid chamber to inhibit image quality deficiency.

The ink jet recording device may further have a detection unit which detects a number of accumulated discharges of ink droplets. When the number of accumulated discharges reaches a predetermined number, the driving unit drives the heating element, whereby a temperature of the recording head becomes equal to or above the set boiling temperature.

In the common liquid chamber, the bubble is increased with printing. The temperature of the recording head is becomes equal to or above the set boiling temperature for each predetermined number smaller than the number of accumulated discharges in which the bubble clogs the individual channel side edge of the common liquid chamber to cause image quality deficiency. The bubble is removed from the common liquid chamber to inhibit image quality deficiency.

The ink jet recording device may further have a head cleaning signal input unit which can input a head cleaning signal to the driving unit from outside. Based on the head cleaning signal inputted from the head cleaning signal input unit, the driving unit drives the heating elements, whereby a temperature of the recording head becomes equal to or above the set boiling temperature.

The user inputs a head cleaning signal from the head cleaning signal input unit to the driving unit. Then the temperature of the recording head becomes equal to or above the set boiling temperature to boil ink in the common liquid chamber. The bubble can be removed reliably.

According to another aspect of the present invention, an ink jet recording device has: a recording head having a common liquid chamber communicated with an outer ink source and with plural ink channels each having a heating element therein; and a driving unit for driving the heating element, wherein the driving unit applies an energy enough to boil an ink contained in the common liquid chamber near the ink channels.

The energy may be enough to discharge an ink in the ink channels.

Alternatively, the energy may not be enough to discharge an ink in the ink channels.

The ink jet recording device may further have: a temperature detector for detecting a temperature of the ink or recording head, wherein the driving unit primarily applies an energy to the heating elements, the energy not being enough to discharge the ink in the common ink chamber until the temperature detector detects a boiling temperature of the ink in the common chamber, and the driving unit secondarily applies an energy to the heating element, the energy being enough to discharge the ink in the common ink chamber after the temperature detector detects the temperature.

The driving unit may be controlled in accordance with an operator's direction.

The ink jet recording device may further have a maintenance unit for maintaining the recording head by vacuuming an ink from the ink channels through an ink discharging portion.

The ink jet recording device may further have a control unit for independently controlling the maintenance unit and the driving unit for independent maintenance movement.

A method may be provided for removing an undesirable bubble formed between a common liquid chamber and ink channels each having a heating element therein in a recording head. The method has the steps of: applying an energy to the heating element until an ink near the ink channels in the common liquid chamber generates a bubble; merging the undesirable bubble and the generated bubble for forming a larger bubble having a relatively large buoyancy in the common liquid chamber; and removing the larger bubble through the common ink chamber due to the buoyancy.

BRIEF DESCRIPTION OF THE DRAWINGS

Preferred embodiments of the present invention will be described in detail based on the followings, wherein.

DESCRIPTION OF THE PREFERRED EMBODIMENTS (First Embodiment)

An ink jet recording device according to a first embodiment of the present invention will be described with reference to FIGS. 1 to 10.

Figure 2:
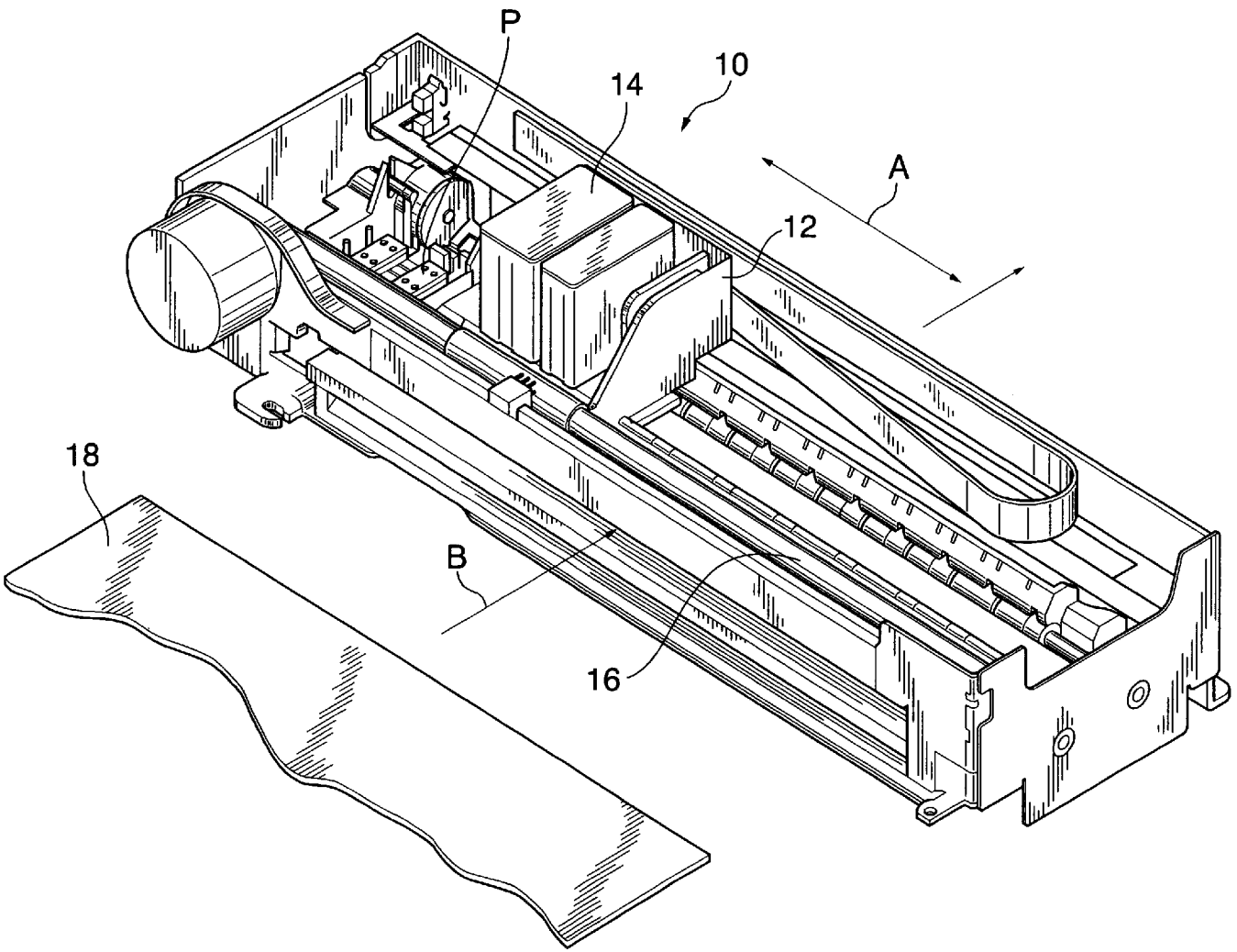
FIG. 2 is a schematic view of an ink jet recording device according to one embodiment of the present invention.

As shown in FIG. 2, in an ink jet recording device 10, an ink jet recording head cartridge (hereinafter, referred to as a cartridge) 14 held in a carriage 12 is scanned along a guide shaft 16 in the arrow A direction and prints a sheet 18 carried tin the arrow B direction.

On the front end of the cartridge 14, a head chip (hereinafter referred to as a recording head) 20 for discharging an ink droplet is disposed.

Figure 3:
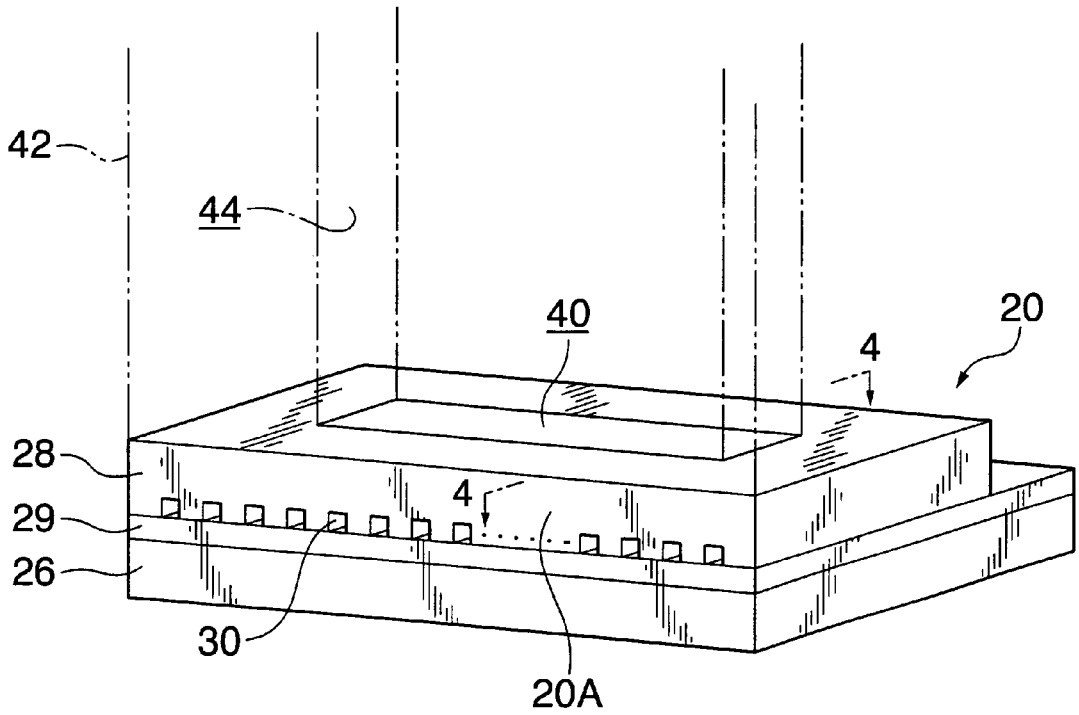
FIG. 3 is a perspective view of the ink jet recording head according to one embodiment of the present invention.
Figure 4A:
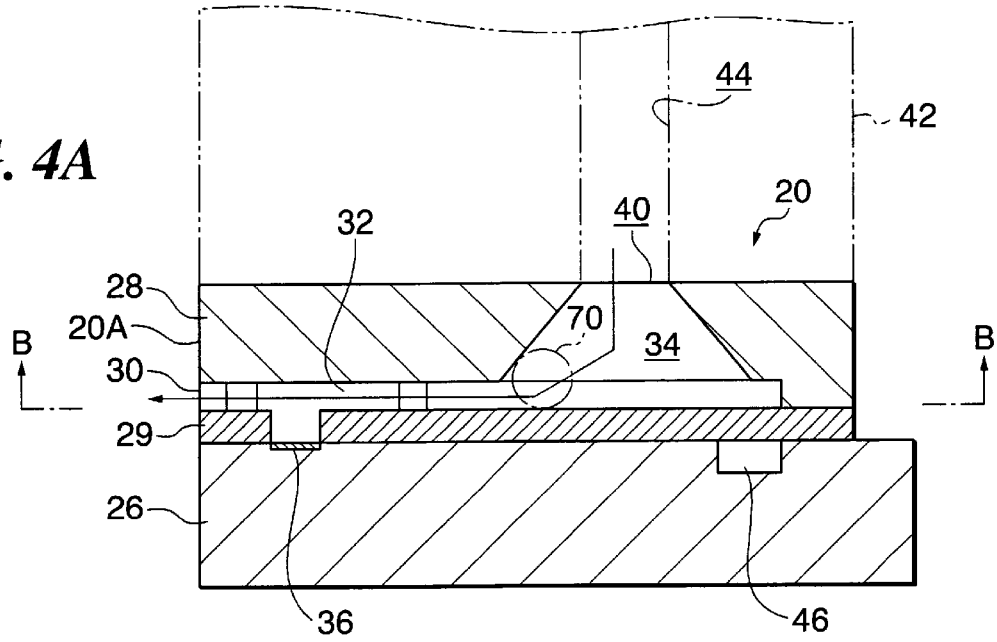
FIG. 4A is a cross-sectional view taken along line 4—4 of FIG. 3
Figure 4B:
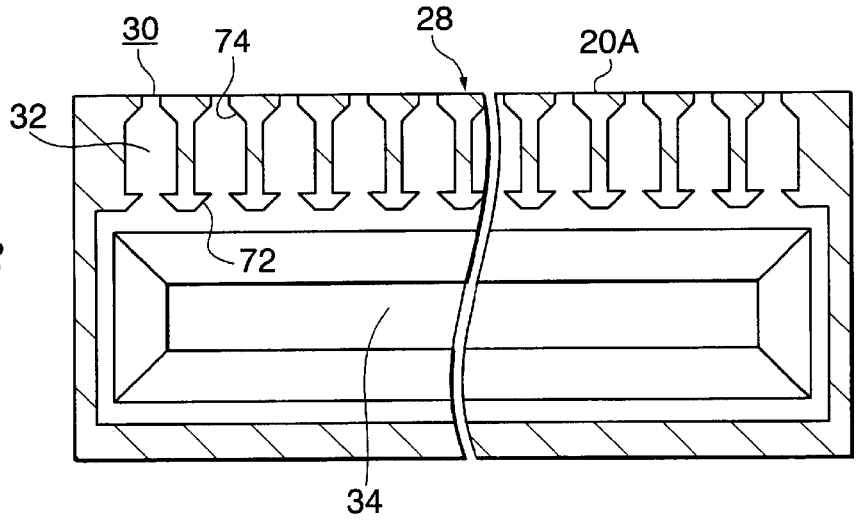
FIG. 4B is a cross-sectional view taken along line B—B of FIG. 4A.

As shown in FIGS. 3 and 4A and 4B, the recording head 20 is formed by joining a heating element substrate 26 and a channel substrate 28 via a protective layer 29, and basically has plural ink discharge openings 30 formed in one end surface (ink discharge surface), individual channels 32 communicated to the ink discharge openings 30, a common liquid chamber 34 communicated to all the individual channels 32 extending in the nozzle arrangement direction, and heating elements 36 (hereinafter, referred to as heating elements) disposed facing the individual channels 32.

An opening portion 40 communicated to the common liquid chamber 34 is formed on top of the recording head 20 and is connected to an ink supply chamber 44 of an ink supply body 42 connected to the recording head 20.

On the surface of the heating element substrate 26 corresponding to the lower portion of the common liquid chamber 34 (the lower side of the protective layer 29), a temperature sensor 46 for detecting the temperature of the recording head 20 (ink in the common liquid chamber) is disposed.

As shown in FIG. 4B, the individual channel 32 of the recording head 20 is formed with an upstream contraction part 72 and a downstream contraction part 74 in which the width of the channel is narrowed on the common liquid chamber side and the ink discharge opening side. This intends to enhance the energy efficiency at ink droplet discharge and to increase the bubble point pressure by reducing the channel width (cross-sectional area). In other words, when a dummy jet (non-printing ink discharge) is performed continuously in the later-described bubble removing control so that the ink refill cannot be attained, ink meniscus (air) is prevented from being included into the common liquid chamber. The ink jet recording head 20 of this embodiment sets the ink surface tension and the channel cross-sectional area of the upstream contraction part 72 so as to provide a bubble point pressure of about 15000 Pa.

Figure 5:
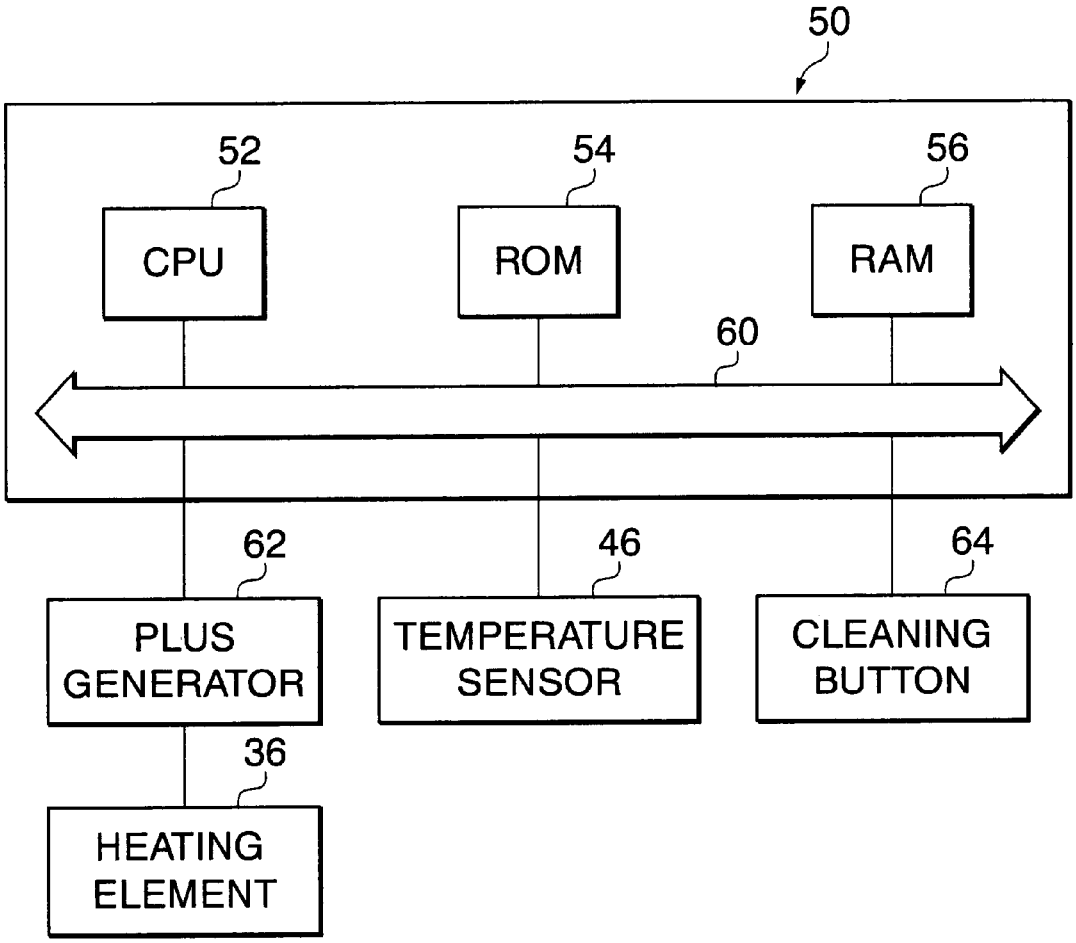
FIG. 5 is a block diagram of a control part according to one embodiment of the present invention.

As shown in FIG. 5, the ink jet recording device 10 has a control part 50 for controlling ink discharge and bubble removal.

The control part 50 has a CPU 52, a ROM 54 and a RAM 56, which are connected by a bus 60. The ROM 54 stores a bubble removing control program so as to remove a bubble by drivingly controlling the heating element 36 based on this program. The control part 50 is connected to a pulse output device 62 for outputting a driving pulse signal to the heating element 36, the temperature sensor 46, and a cleaning button 64 for the user to command the later-described bubble removing control via the bus 60.

The operation of the thus-constructed ink jet recording device 10 will be described.

A printing operation will be described simply. In this case, image data is inputted to the control part 50. The control part 50 outputs a printing driving signal corresponding to the image data to the pulse generator 62. A printing pulse signal having a pulse width of 2.5 $\mu$sec is applied to the heating elements 36. As a result, ink on the heating elements 36 boils the film to produce a bubble so as to discharge an ink droplet from the ink discharge opening 30 for printing.

In this case, the temperature of the recording head 20 is monitored all the time by the temperature sensor 46. When the temperature reaches the printing limiter temperature, the printing operation is stopped once to lower the temperature to a predetermined temperature for restarting printing. This prevents image quality deficiency discharging no ink droplet in such a manner that the ink refill is slow due to ink temperature rise in the individual channel 32 and the heating elements 36 are driven while no ink is on the heating element 36.

Figure 6:
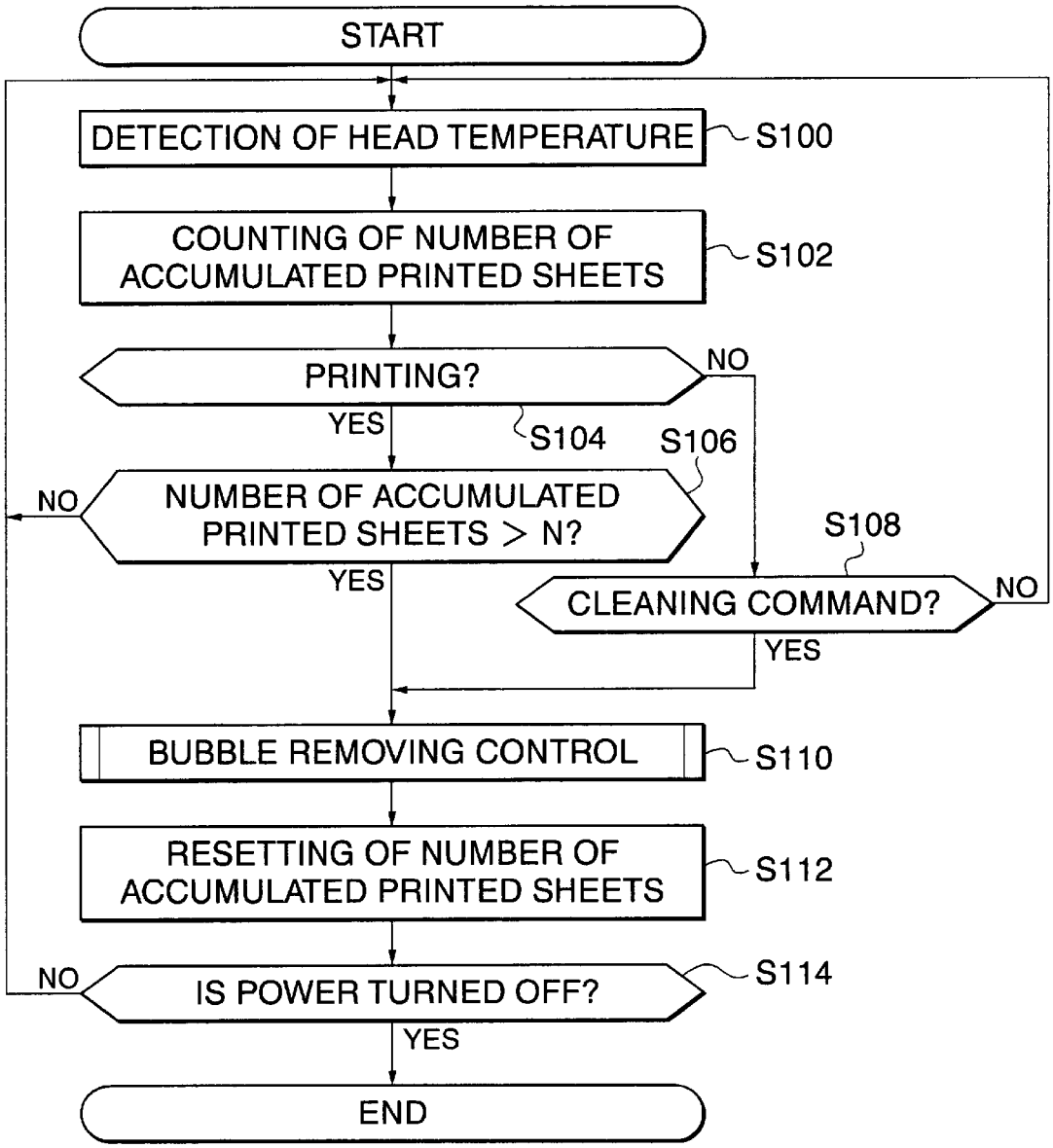
FIG. 6 is a main flowchart of bubble removing control according to a first embodiment of the present invention.

The bubble removing control will be described with reference to the flowchart of FIG. 6.

Upon turning the power on, the temperature sensor 46 detects the temperature of the recording head 20, which is then stored into the RAM 56 of the control part 50 (step 100).

A sheet counter, not shown, of the ink jet recording device 10 starts counting the number of accumulated printed sheets (step 102).

Whether printing is being performed or not is judged based on whether an image data signal is inputted to the control part 50 or not (step 104).

In the case of printing, whether the number of accumulated printed sheets reaches N sheets or not is judged (step 106). The above steps 100 to 104 are repeated until the number of accumulated printed sheets reaches N sheets. When the number of accumulated printed sheets reaches N sheets, the later-described bubble removing control is performed so as to remove a bubble which clogs the individual channel side edge of the common liquid chamber 34 (step 110).

Since the ink jet recording device 10 increases the bubble amount in the common liquid chamber 34 with its use, the possibility of causing image quality deficiency is increased. Each time the number of accumulated printed sheets reaches a predetermined number of sheets (N sheets), the later-described bubble removing control is performed, thereby preventing the image quality deficiency.

In the case of non-printing, whether a cleaning command is inputted from the cleaning button 64 to the control part 50 or not is judged (step 108). When not inputted, the above steps 100 to 104 are repeated. When the cleaning command is inputted, the later-described bubble removing control is performed (step 110).

When the user sees the printed matter to confirm image quality deficiency and inputs the cleaning command from the cleaning button 64, the bubble removing control is performed even when the number of accumulated printed sheets does not reach N sheets, thereby recovering from the image quality deficiency.

After terminating the bubble removing control, the sheet counter is reset (step 112). At the next control, the number of accumulated printed sheets is counted from 0 again.

Whether the power is turned off or not is judged (step 114) and the above control is repeated until the power is turned off.

Figure 7:
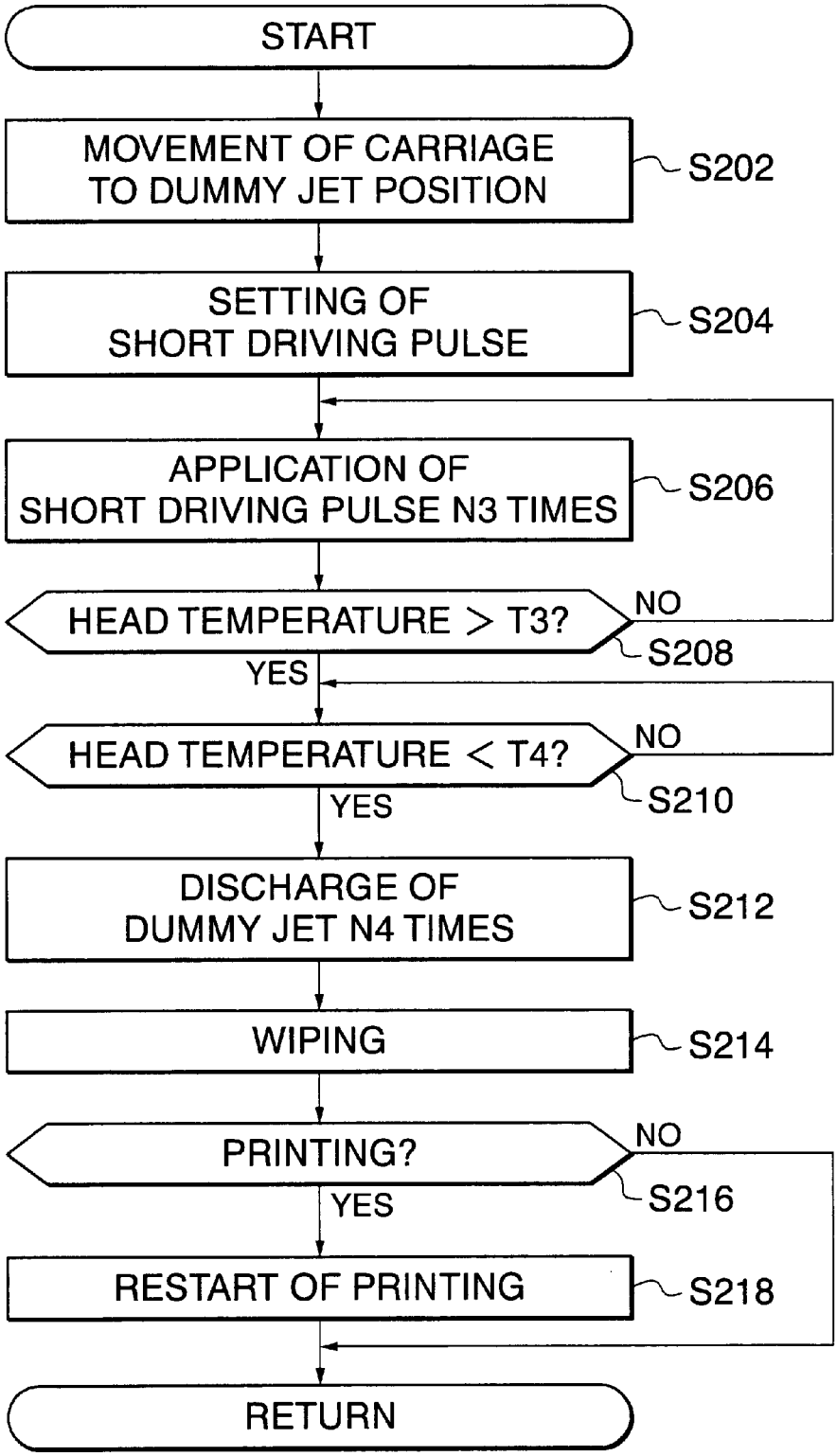
FIG. 7 is a flowchart of bubble removing control according to the first embodiment of the present invention.

The bubble removing control will be described in detail with reference to the flowchart of FIG. 7 and FIGS. 1 and 8.

In the case of printing, the CPU 52 outputs a driving stop signal to the pulse generator 62. The output of the pulse signal from the pulse generator 62 is stopped to stop driving (printing operation) of the heating element 36.

A moving signal from the CPU 52 is outputted to a carriage driver, not shown, to move the carriage 12 to a dummy jet position P (step 202).

Figure 1A:
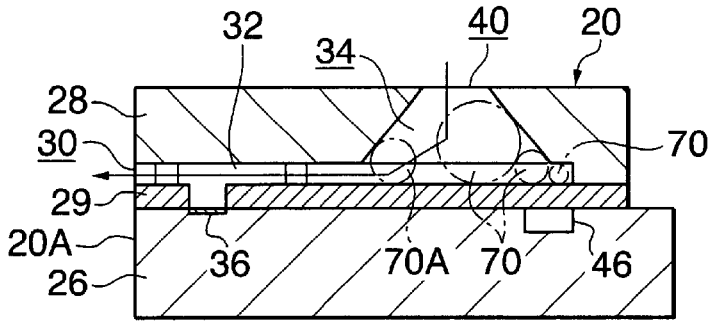
FIGS. 1A to 1D are respectively explanatory views of a bubble removing state of an ink jet recording head according to one embodiment of the present invention.
Figure 1B:
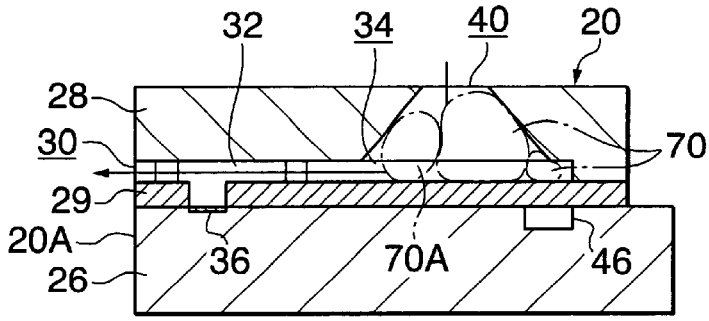
Figure 8A:
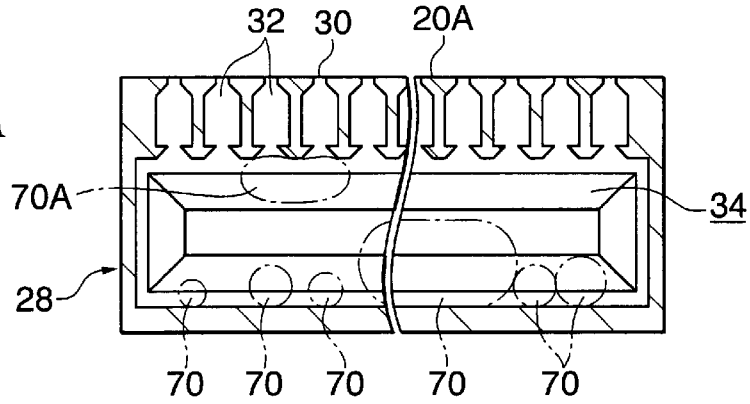
FIGS. 8A to 8D are respectively explanatory views of a bubble removing state of an ink jet recording head.
Figure 8B:
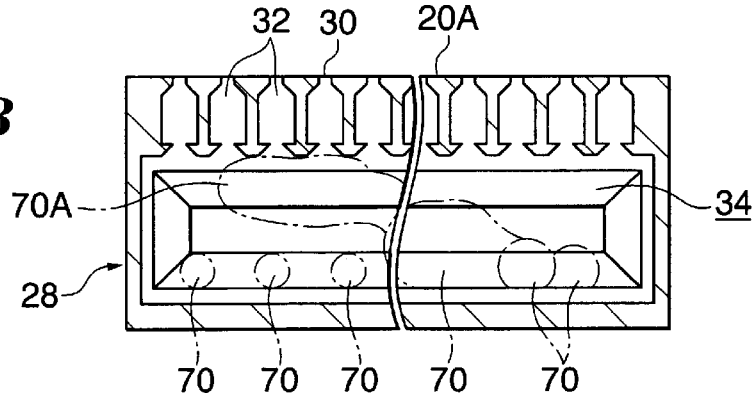

At this point, the number of accumulated printed sheets reaches N sheets (or a degree to cause image quality deficiency). As shown in FIGS. 1A and 8A, many bubbles 70 are produced in the common liquid chamber 34. A bubble 70A is attached to the individual channel side edge of the common liquid chamber 34 to clog the individual channel 32.

When the printing operation is continued in this state, the common liquid chamber 34 cannot supply ink to the individual channel 32, resulting in image quality deficiency.

The CPU 52 sets a short driving pulse signal (pulse width of 1.0 μsec) which has a pulse width smaller than that of the printing pulse signal (pulse width of 2.5 μsec). The short driving pulse signal is applied to all the heating elements 36 via the pulse generator 62 to drive the heating elements 36 N3 times (steps 204 and 206). The heating elements 36 are driven by the short pulse signal (pulse width of 1.0 μsec) having a pulse width smaller than that of the printing pulse signal (pulse width of 2.5 μsec). No ink droplets can be discharged from the ink discharge opening 30 so that ink in the individual channel 32 is only heated.

Figure 11:
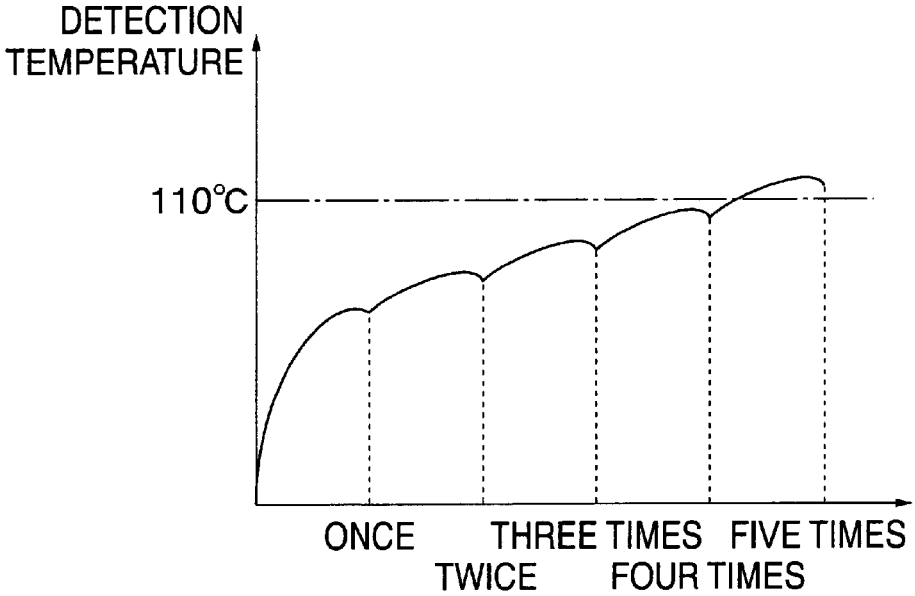
FIG. 11 is a diagram showing the heating state of the recording head according to the first embodiment of the present invention.

With the heating operation, whether the temperature of the recording head 20 (hereinafter, referred to as a head temperature) becomes equal to or above T3° C. (equal to or above the ink boiling point, for example, 110° C.) or not is judged based on the output of the temperature sensor 46. The heating operation is repeated N3 times until the head temperature (the ink temperature in the common liquid chamber) reaches T3° C. (steps 206 and 208). For example, when N3 times is five times, the head temperature is changed to exceed 110° C. (T3° C.), as shown in FIG. 11.

The heating operation is performed continuously to boil the ink in the common liquid chamber 34, thereby discharging a bubble outside. This process will be described below. In the conditions described here in which an ink boiling phenomenon occurs in the common liquid chamber 34, to the recording head having a nozzle arrangement of 800 dpi and 512 nozzles in total, a driving pulse signal having a driving frequency of 20 kHz, a driving voltage of 32V, a driving current of 100 mA, and a driving pulse of 2.5 μsec is inputted.

The head temperature is increased to some extent so that the bubbles 70 are expanded. Reduction of the ink surface tension decreases the attaching force of the bubble 70A to the wall surface of the common liquid chamber 34. As a result, the bubble 70A is coalesced into other bubbles 70 to start integration (see FIGS. 1B and 8B).

When the heating operation is performed continuously so that the head temperature becomes equal to or above T3° C., the ink refill cannot be attained to the individual channel 32. There is provided an idle discharge state in which the heating elements 36 are driven in no ink state in the individual channel 32. In other words, the ink meniscus position in all the individual channels 32 is at the common liquid chamber side edge.

Figure 1C:
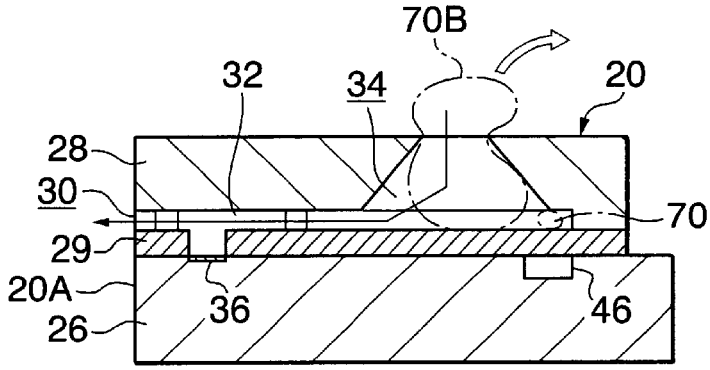
Figure 1D:
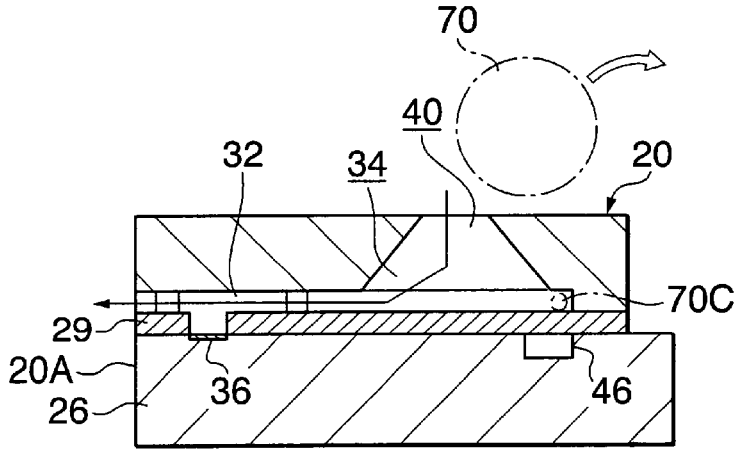
Figure 8C:
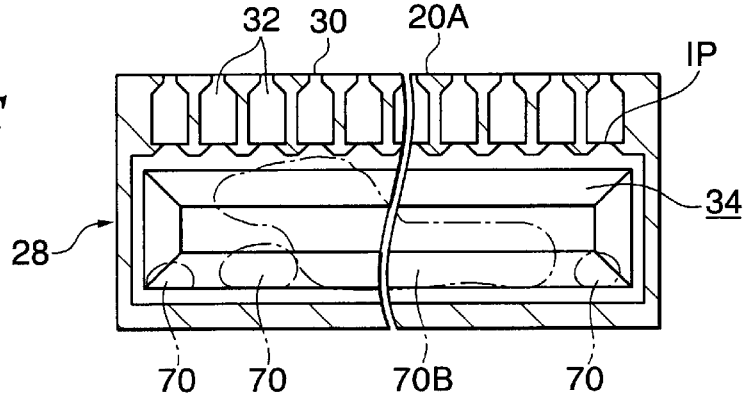
Figure 8D:
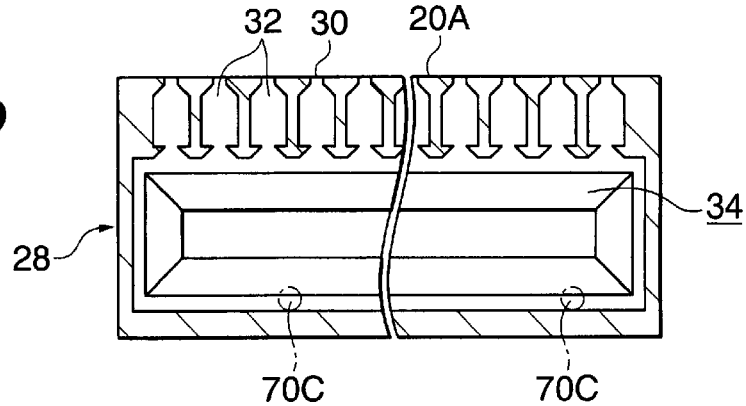

As a result, as shown in FIGS. 1C and 8C, the attached portion of the bubble 70A attached to the common liquid chamber side edge of the individual channel 32 is heated abruptly. The attaching force is reduced greatly, and the bubble 70A is expanded to be integrated with other bubbles 70. An integrated bubble 70B is moved to the upper side of the common liquid chamber 34 and then, is moved from the ink supply opening 40 to the ink supply chamber 44 side.

When the head temperature exceeds T3° C., the pulse generator 62 stops the output of the short driving pulse signal by the stop signal from the CPU 52. As a result, the driving of the heating elements 36 is stopped to spontaneously cool the recording head 20 until the head temperature is lowered to T4° C. (for example, 40° C.) (steps 208 and 210).

The bubble 70B increased during the spontaneous cooling period is moved from the ink supply opening 40 to the ink supply chamber 44 by its floating force. The bubbles 70 which clog the edge of the individual channel 32 from the common liquid chamber 34 to cause image quality deficiency can be removed (see FIG. 1D). The recording head 20 is cooled to lower the ink temperature and bubbles 70C remaining in the common liquid chamber 34 are reduced to a sufficiently small size (smaller than the common liquid chamber side edge section of the individual channel 32) (see FIG. 8D).

The temperature of the ink boiled in the common liquid chamber 34 is lowered by spontaneous cooling. When the head temperature is cooled to T4° C., the printing pulse signal (pulse width of 2.5 μsec) is applied to all the heating elements 36 to perform a dummy jet N4 times (for example, 3000 times) (step 212).

The carriage 12 is scanned along the guide shaft 16 to slide a wiping member, not shown, and a nozzle surface 20A of the recording head 20 to remove solidified ink from the nozzle surface (step 214).

Such an operation is performed after cooling the ink. The thickened ink by cooling after boiling can be reliably prevented from being solidified at the nozzle front end to change the ink discharge direction and from allowing the ink not to be discharged.

When the dummy jet and wiping process are terminated, printing is restarted in the case of printing before the bubble removing control and the printing wait state is returned in the case of non-printing (steps 212 and 214).

The operation of the bubble removing control will be described.

The short driving pulse signal is applied to the heating elements 36 until the head temperature becomes equal to or above T3° C. at which the ink in the common liquid chamber 34 is boiled, and then, continuously drives the heating elements 36. The bubble 70A clogging the individual channel side edge in the common liquid chamber 34 is spaced from the wall surface and is integrated with other bubbles 70 to be moved from the ink supply opening 40 of the common liquid chamber 34 to the ink supply chamber 44.

In particular, a bubble clogging the plural adjacent individual channels 32 which cannot be discharged from the ink discharge opening 30 by a normal dummy jet at the individual channel side edge of the common liquid chamber 34 can be preferably removed from the common liquid chamber 34.

To remove the bubble clogging the individual channel 32 in the common liquid chamber 34, the bubble can be preferably removed by a simplified construction, without providing dummy nozzles for bubble discharge and adding a special unit such as vacuum device.

When boiling the ink in the common liquid chamber 34, the short pulse signal (pulse width of 1.0 μsec) having a pulse width smaller than that of the printing pulse signal (pulse width of 2.5 μsec) is applied to the heating elements 36 to heat the ink. Ink discharge need not be performed for heating. Ink wasting is avoided and the waste ink can be prevented from being increased.

The heating operation is performed continuously to increase the head temperature to T3° C. A bubble can be suctioned from the ink meniscus positioned at the common liquid chamber side edge of the individual channel 32. The upstream contraction part 72 having a width smaller than the disposing portion of the heating element 36 is provided in the individual channel 32 to prevent air from being suctioned.

Figure 9:
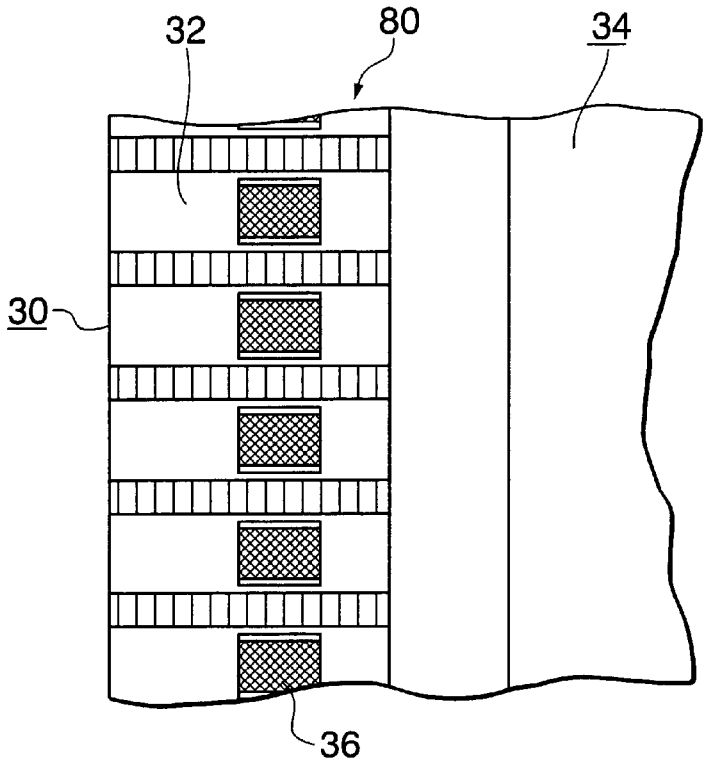
FIG. 9 is a plan view near the individual channel of an ink jet recording head according to a comparative example.

The air suction will be described with reference to an ink jet recording head 80 of a comparative example. As shown in FIG. 9, the width of the individual channel 32 is fixed in the ink jet recording head 80. The heating operation is performed continuously in the above bubble removing control until the head temperature becomes equal to or above T3° C. Since the channel resistance is lowered, ink meniscus is moved into the common liquid chamber by the negative pressure of the ink supply system to suction air into the common liquid chamber 34. As a result, since the ink in the common liquid chamber 34 and the ink supply chamber is almost empty, printing (ink discharge) is disabled in all the ink discharge openings 30. To recover the printable state from this state, the recording head 80 must be suctioned by a negative-pressure pump to refill ink to the ink supply chamber, the common liquid chamber, and the individual channel.

The recording head 20 of this embodiment forms the upstream contraction part 72 in the individual channel 32. A dummy jet is performed in the bubble removing control while the ink refill cannot be attained. Since the bubble point pressure of the upstream contraction part 72 is high, it is possible to reliably prevent the ink meniscus from being included into the common liquid chamber 34 to introduce air (bubble) from outside into the common liquid chamber 34. The above bubble removing control can reliably remove the bubble in the common liquid chamber 34.

The recording head 20 is also considered to be constructed below in order to prevent a bubble from being attached to the common liquid chamber side edge of the individual channel 32 to inhibit ink supply.

Figure 10:
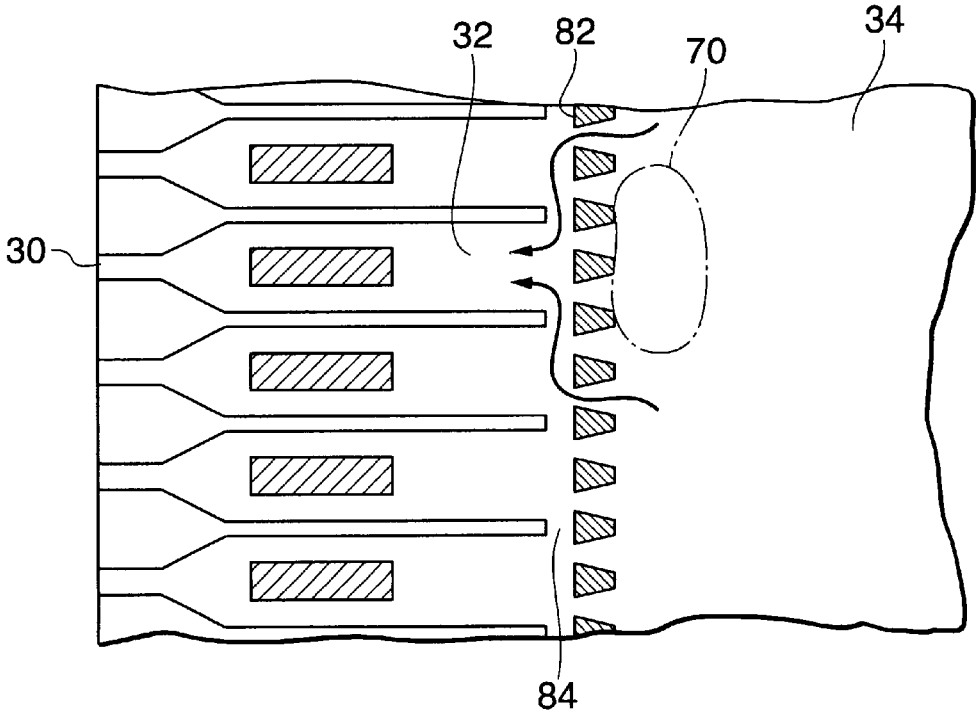
FIG. 10 is a partial explanatory view showing another example of the ink jet recording head according to the present invention.

As shown in FIG. 10, pillars 82 are formed on the individual channel 32 side of the common liquid chamber 34 to be spaced at fixed intervals (below the channel width of the individual channel 32) in the arrangement direction of the individual channel 32 at a fixed distance from the edge of the individual channel 32. Between the pillars 82 and the common liquid chamber side edge of the individual channel 32, a path 84 is formed in the arrangement direction of the individual channel 32.

The recording head 20 is thus formed. The bubbles 70 of a size which can clog the common liquid chamber side edge of the individual channel 32 cannot pass between the pillars 82, and then, are attached to the pillar 82. The common liquid chamber side edge of the individual channel 32 will not be clogged by the bubbles 70. Ink can be supplied to the individual channel 32 via the path 84 from between the pillars 82 to which the bubbles 70 are not attached (see the arrow of FIG. 10).

In this embodiment, a short pulse signal not discharging ink is applied to the heating elements 36 to perform the heating operation. The printing pulse signal may be applied to the heating elements 36 for heating by a method for performing non-printing ink discharge (dummy jet). In this case, there is the advantage that only the printing pulse signal can perform the heating operation (bubble removing control).

In this embodiment, a pulse width to be applied to the heating elements 36 in order to pre-heat the ink is modulated. Another method which can reduce an energy to be applied to the heating elements 36 may be used which lowers the applying voltage level.

(Second Embodiment)

An ink jet recording device according to a second embodiment of the present invention will be described. The same components as the first embodiment are indicated by similar reference numerals, and the detailed description thereof is omitted.

Figure 12:
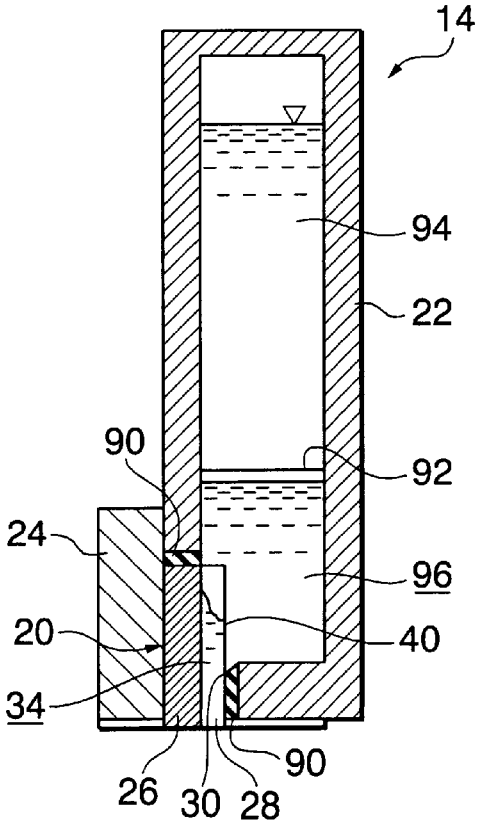
FIG. 12 is a longitudinal sectional view showing an ink jet recording cartridge according to a second embodiment of the present invention.

As shown in FIG. 12, the cartridge 14 basically has a recording head 20 similar to the first embodiment, an ink supply body 22 for supplying ink to the recording head 20, and a heat sink 24 for holding heat releasability of the recording head 20.

The ink supply body 22 is of a shape formed with an opening portion in one of corners of the lower end portion of a substantially rectangular parallelepiped box. The recording head 20 is fitted in the opening portion via an elastic seal member 90. The recording head 20 is integrated with the ink supply body 22. In the ink supply body 22, an ink tank chamber 94 of a substantially rectangular parallelepiped and an ink supply chamber 96 which are divided into two by a filter 92 are formed.

In the ink supply chamber 96, a sufficiently large volume is held for the recording head 20. The horizontal section (in the lateral direction in the drawing) is held largely. A bubble 70 moved from the common liquid chamber 34 to the ink supply chamber 96 is floated reliably to be spaced from an ink supply opening 40 of the recording head 20.

In the ink tank chamber 94, ink can be supplied from a sub ink tank which can be attached or removed on top of the exterior main ink tank and the cartridge 14 (not shown).

In the arrangement direction of the cartridge 14, at least the ink tank chamber 94, the ink supply chamber 96 and the ink discharge opening 30 (individual channel 32) must be arranged in the lower side in the gravitational direction in that order for the bubble removing control.

The operation of the thus-constructed ink jet recording device will be described.

The bubble moved from the ink supply opening 40 of the common liquid chamber 34 to the ink supply chamber 96 by the above bubble removing control is moved by the floating force of the bubble itself to the upper side in the gravitational direction in the ink supply chamber 96, that is, to the ink tank chamber 94. In this manner, the volume of the ink supply chamber 96 is held largely. A bubble 70B discharged from the ink supply opening 40 to the ink supply chamber 96 can be prevented from being attached to the wall surface near the ink supply opening 40 to inhibit ink supply to the common liquid chamber 34.

In the ink supply chamber 96, the section orthogonal in the ink flow direction (the horizontal section) is increased to design the recording head 20 below so that the bubble 70B is floated reliably against the ink flow.

The floating force and resistance force acting on the bubble in the ink supply chamber 96 are considered as follows.

When a minimum cross-sectional area in the ink flow direction of the ink supply chamber is S, an average ink flow rate during printing is Q, an ink density is ρ, a gravitational constant is g, a resistance coefficient is Cd, and a bubble diameter is d, a resistance force acting on a bubble is F1, which is given by the equation:

$$F1=[(Q/S)^2\times Cd\times\rho\times\pi\times d^2]/8 \quad (1)$$

The floating force acting on the bubble is F2, which is given by the equation:

$$F2=(\rho\times g\times\pi\times d^3)/6 \quad (2)$$

When the floating force F2 acting on the bubble is larger than the resistance force F1 by ink flow (F2>F1), the equation is satisfied as follows:

$$(\rho\times g\times\pi\times d^3)/6>[(Q/S)^2\times Cd\times\rho\times\pi\times d^2]/8 \quad (3)$$

The bubble rises by its floating force to the upper side in the vertical direction (from the individual channel 32 of the head to the filter 92 side in this embodiment).

In the resistance coefficient Cd, when the Reynolds number Re<1, Cd=24/Re is established. When an ink viscosity is $\mu$ and an ink flow velocity is v, the Reynolds number Re is expressed to be Re=ρ×v×d/$\mu$. From the equation (1), $$F1=3\times\pi\times\mu\times v\times d \quad (4)$$

When the equation (4) is substituted into the equation (3), a bubble diameter d is given by the equation:

$$d>[(18\times\mu\times v)/(\rho\times g)]^{1/2} \quad (5)$$

The bubble diameter d shows a bubble diameter in which the floating force F2 is larger than the resistance force F1 of the ink flow. When the minimum cross-sectional area S is designed so that the bubble diameter d is smaller than the diameter of the bubble 70B, thereby reliably floating the bubble 70B.

(Test)

To confirm the above operation, a continuous printing operation of a predetermined number of sheets is actually performed in the embodiment (the ink jet recording device of a third embodiment). Thereafter, a change in a bubble amount by performing the bubble removing control shown in the first embodiment is tested.

The head printing specification of the test example has 512 ink discharge openings (individual channels) at a resolution of 800 dpi. A printing frequency is 20 kHz, a drop amount is 5 pl, and a printing speed of A4 size paper is 5 ppm (sheets/minute). The cross-sectional area S in the flow direction of the ink supply chamber 96 in the embodiment is 300 $mm^2$.

Inks used in the test example has an ink viscosity of $\mu$=2.01 Pa·sec and an ink density ρ=1050 kg/$mm^3$. An image used for printing evaluation has a printing coverage of 15%.

The test results are shown in Table 1.

TABLE 1

| Printing coverage of the number of continuously printed sheets: 15% | Initial state of a bubble amount ($mm^3$) | After continuous printing of a bubble amount ($mm^3$) | After bubble removal of a bubble amount ($mm^3$) | Bubble amount decrease % (a bubble decrease/ an amount after printing 1000 sheets) |
|---|---|---|---|---|
| 200 sheets | 0 | 0.84 | 0.02 | 98% |
| 400 sheets | 0 | 1.66 | 0.02 | 99% |
| 1000 sheets | 0 | 1.78 | 0.02 | 99% |

In this manner, in the embodiment, after continuous printing of 200, 400 and 1000 sheets, the respective bubble removing controls are performed. It is found that most bubbles (98% to 99%) in the common liquid chamber can be removed.

(Third Embodiment)

An ink jet recording device according to a third embodiment of the present invention will be described. The same components as the first embodiment are indicated by similar reference numerals, and the detailed description thereof is omitted.

In this embodiment, a method for eliminating clogging in the ink jet recording device will be described. When the ink jet recording device is not used for a long time, moisture is evaporated from the ink supplied to the recording head to increase the ink viscosity. As a result, ink clogging is caused in the individual channel 32, and ink is adhered to the nozzle surface so as to affect the ink droplet discharge direction, resulting in deterioration of the printing performance.

To eliminate this phenomenon (hereinafter, referred to as clogging), the relation between the ink viscosity and the ink temperature is used.

How ink viscosity is changed due to evaporation (a decrease in moisture) and temperature will be described.

Figure 13:
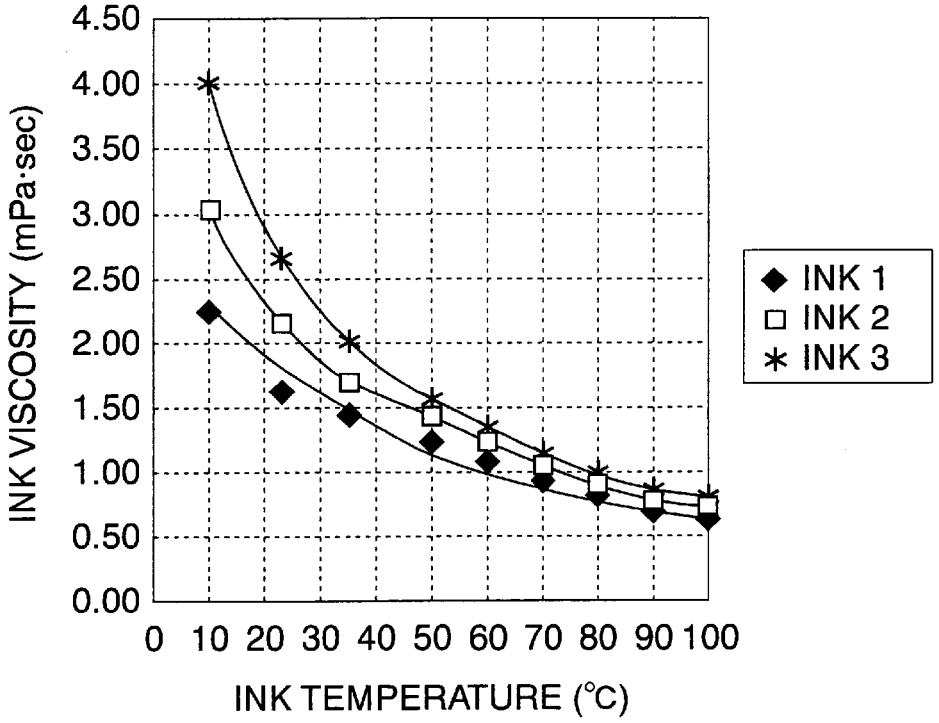
FIG. 13 is a graph showing the relation between the ink temperature and viscosity.

FIG. 13 is a graph showing the relation between the viscosity and the temperature in three kinds of inks used in the ink jet recording device of the present invention.

Inks 1 to 3 shown here are composed as follows. The ink compositions are only an example. The present invention can be applied to inks having different compositions.

| (Ink 1) | |
|---|---|
| Coloring agent A | 28.6 parts by weight |
| Diethyleneglycol | 15 parts by weight |
| Polyoxyethylene oleyl ether (oxyethylene = 30 mol) | 0.03 parts by weight |
| NaOH | 0.07 parts by weight |
| Pure water | 56.3 parts by weight |

After mixing the above compositional gradients, the composition is obtained by filtering with a 1-$\mu$m-membrane filter.

| (Ink 2) | |
|---|---|
| Coloring agent A | 28.6 parts by weight |
| Diethyleneglycol | 15 parts by weight |
| 2-propanol | 3 parts by weight |
| Urea | 6 parts by weight |
| NaOH | 0.07 parts by weight |
| Pure water | 47.33 parts by weight |

After mixing the above compositional gradients, the composition is obtained by filtering with a 1-$\mu$m-membrane filter.

| (Ink 3) | |
|---|---|
| Coloring agent B | 29.6 parts by weight |
| Diethyleneglycol | 15 parts by weight |
| 2-propanol | 3 parts by weight |
| Polyoxyethylene oleyl ether (oxyethylene = 30 mol) | 0.1 parts by weight |
| Urea | 6 parts by weight |
| N,N-bis (2-hydroxyethyl)-2-aminoethanesulfonic acid | 1.2 parts by weight |
| NaOH | 0.24 parts by weight |
| Pure water | 44.86 parts by weight |

After mixing the above compositional gradients, the composition is obtained by filtering with a 1-$\mu$m-membrane filter.

As shown in FIG. 13, in any of the inks 1 to 3, as the ink temperature is increased, the ink viscosity is found to be lowered. Under normal printing conditions, the ink temperature is about 35° C. to 50° C. The ink viscosity is a value of about 1.25 to 2.0 mPa·sec.

In the ink jet recording device (recording head) left so as not to perform printing for a long time, ink is evaporated from the ink discharge opening 30 to gradually increase the ink viscosity in the common liquid chamber of the recording head.

A water-based ink has an ink composition has water, a humectant, a coloring agent (dye or pigment) and other additives. Most of it contains water (about 60 to 80%) and a humectant (about 10 to 20%).

Figure 14:
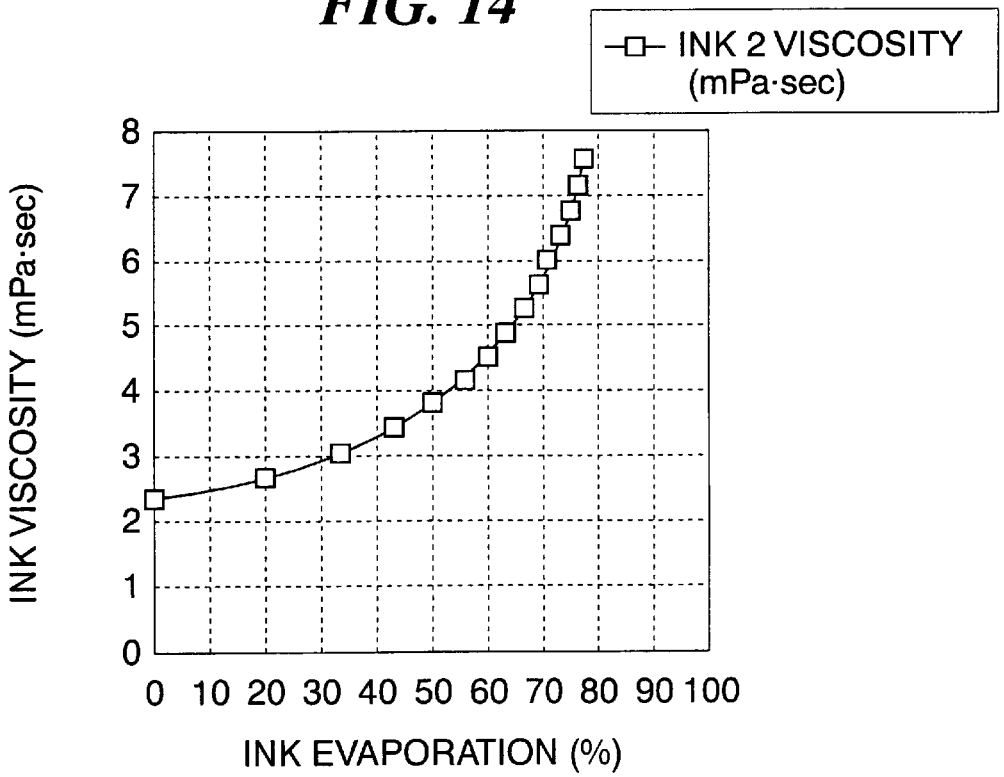
FIG. 14 is a graph showing the relation between the ink evaporation and viscosity.

FIG. 14 shows a graph showing the relation between the ink 2 evaporation and viscosity. When the ink evaporation is advanced so that about 80% of the ink is evaporated, the ink viscosity at 23° C. is increased three times or more, from 2.3 mPa·sec to 7.6 mPa·sec. Most of the ink evaporation includes water evaporation. This means that moisture in the ink is evaporated to some extent and further evaporation is inhibited. The ink 2 is saturated when the evaporation is about 80%. It is found that further evaporation will not be performed.

The ink in the common liquid chamber 34 of the recording head is thickened to 7.6 mPa·sec. Application of the printing pulse signal to the heating elements 36 cannot discharge the ink from the ink discharge opening 30. The ink discharge opening 30 forcefully discharges the thickened ink by suction maintenance for recovery in the related art manner.

Figure 15:
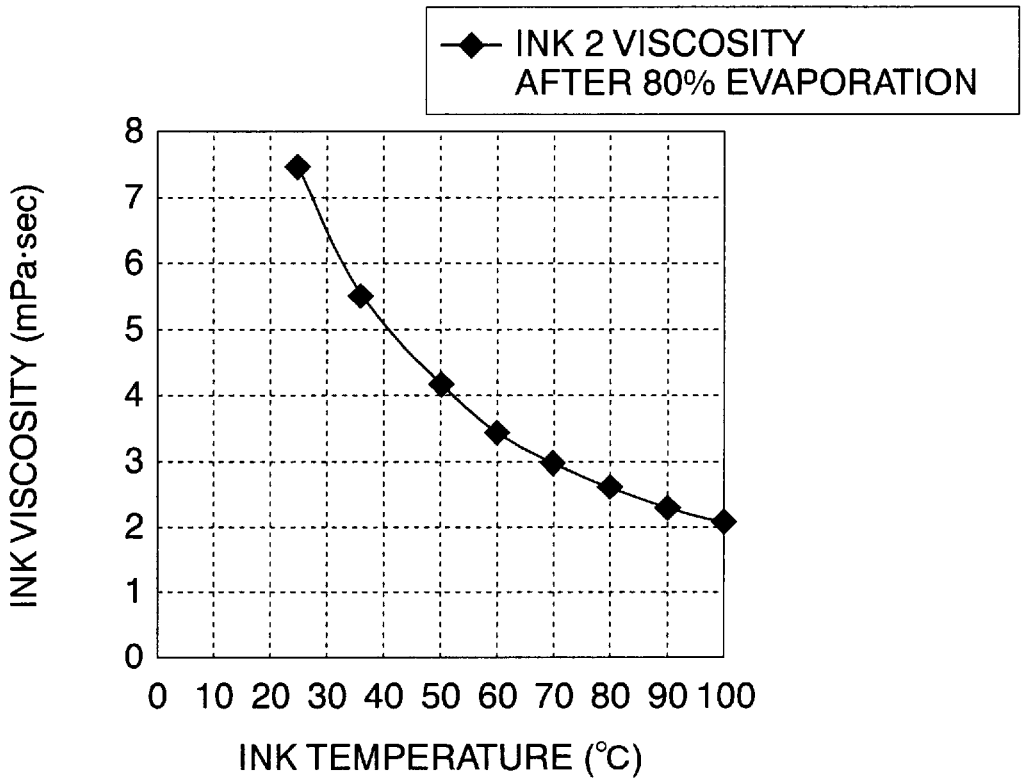
FIG. 15 is a graph showing the relation between the ink temperature and viscosity after 80% evaporation.

FIG. 15 shows the relation between the ink temperature and the viscosity of the ink 2 thickened after 80% evaporation. From this result, when the temperature of the ink thickened by evaporation is raised to about the ink normal boiling point (100° C.), the viscosity can be lowered to a very low value of 2.1 mPa·sec.

Figure 16:
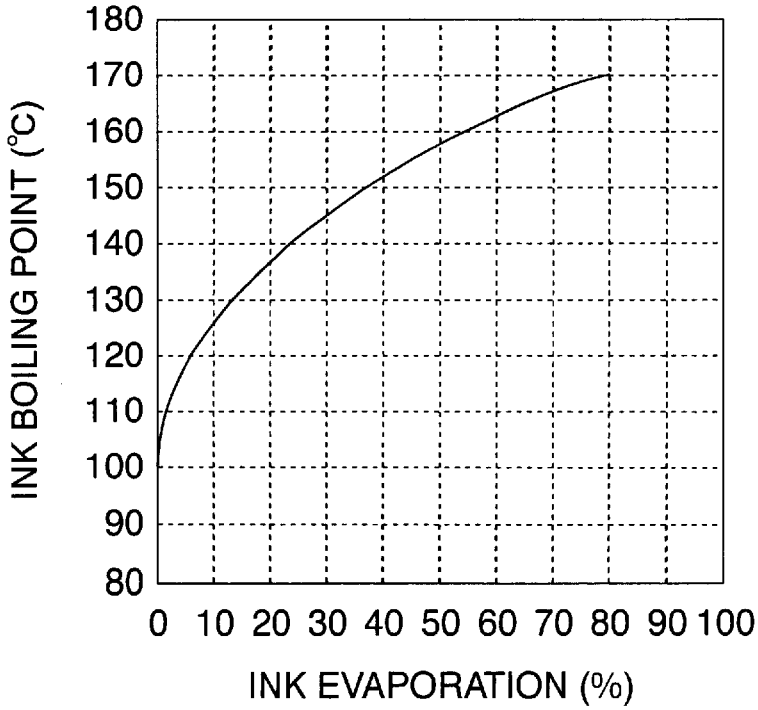
FIG. 16 is a graph showing the relation between the ink evaporation and the ink boiling point.

FIG. 16 shows the relation between the evaporation and the ink boiling point (boiling temperature). As shown here, the ink boiling point is found to be increased according to the evaporation. It is found that when the temperature of the thickened ink 2 having a 80% evaporation is raised to about the boiling point at normal (0 to 20% evaporation), the ink 2 is not boiled.

This embodiment eliminates ink clogging based on the above findings.

Figure 17:
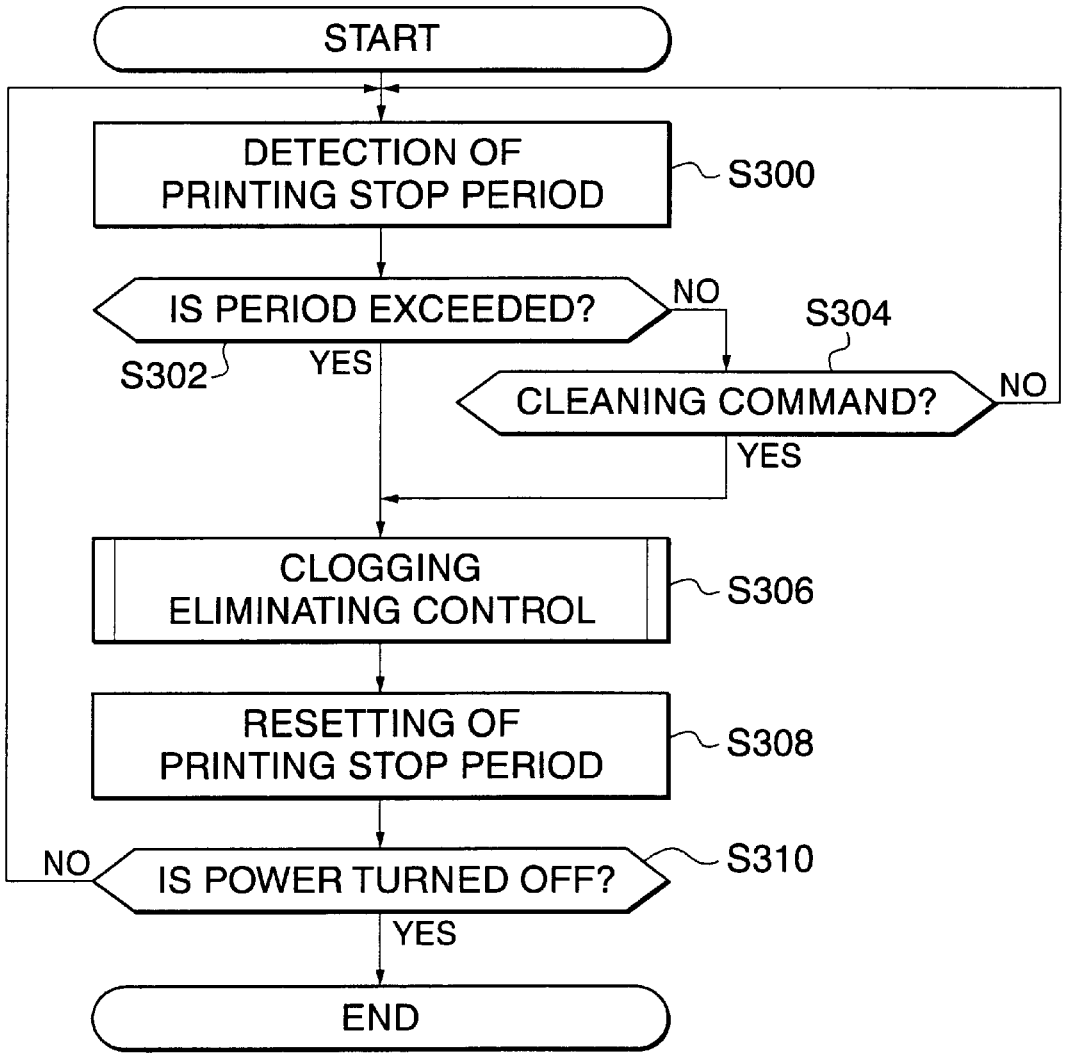
FIG. 17 is a main flowchart of bubble removing control according to the second embodiment of the present invention.
Figure 18:
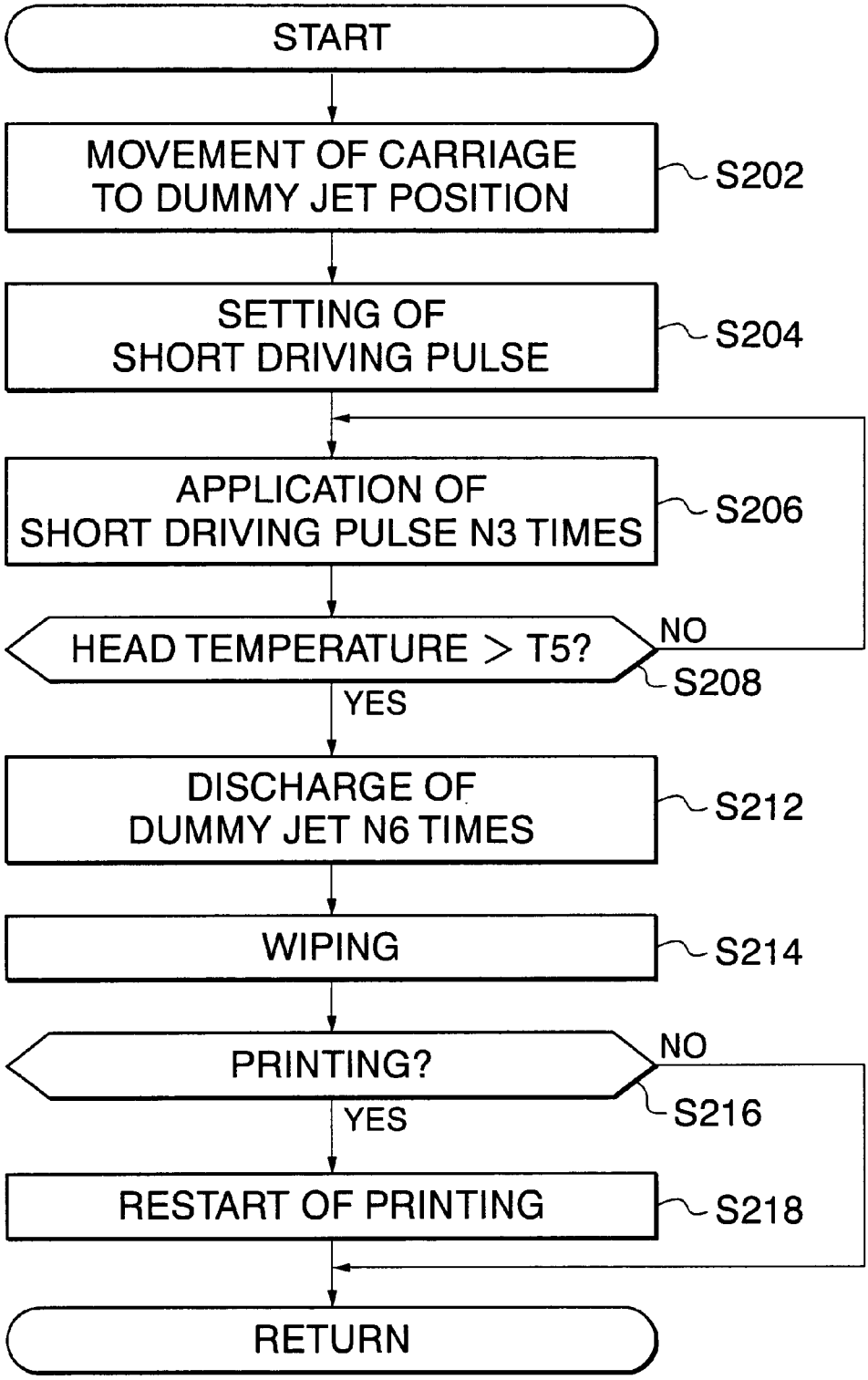
FIG. 18 is a flowchart of bubble removing control according to the second embodiment of the present invention.

Specific clogging eliminating control will be described with reference to the flowcharts of FIGS. 17 and 18.

When the ink jet recording device 10 is turned on, the control part 50 detects a printing stop period from the previous printing by a timer, not shown (step 300).

The control part 50 judges whether the detected printing stop period is longer than the set period or not (step 302). As described above, when the printing stop period is long, the ink evaporation from the ink discharge opening 30 is advanced to thicken the ink in the recording head 20 (the common liquid chamber 34) causing clogging. Comparing to the set stop period, a clogging state (ink viscosity) is judged.

When the printing stop period is shorter than the set period, whether or not the cleaning command is inputted from the user to the control part 50 is detected (step 304).

With the user command, the later-described clogging eliminating control is performed aside from the above judgment.

When the printing stop period is longer than the set period (YES in step 302) or the cleaning command is inputted (YES in step 304), the later-described clogging eliminating control is performed (step 306).

After terminating the clogging eliminating control, the printing stop period of the timer is reset to repeat the above control until the power is turned off (steps 308 and 310).

The clogging eliminating control will be described with reference to FIG. 18. The same steps as the bubble removing control of the first embodiment are indicated by similar reference numerals, and the detailed description thereof is omitted. Only different points will be described.

The point in which the short pulse signal is applied to the heating elements 36 to heat ink in the recording head 20 (the common liquid chamber 34 and the individual channels 32)

is the same as the bubble removing control except that ink is heated until the head temperature is the normal boiling temperature T5. As shown in FIG. 13, when the ink temperature is heated to about 100° C., the ink viscosity is reduced to about ⅓ so that the ink can be discharged outside. On the other hand, when the ink is boiled, the ink meniscus position is moved to the common liquid chamber side of the individual channel 32 so that ink discharge cannot be done quickly.

As shown in FIG. 16, the ink boiling point (boiling temperature) depends on the ink evaporation. When the ink evaporation is increased, the ink boiling point is also increased. When the ink temperature is heated to about 100° C., ink whose ink evaporation causing clogging is equal to or above 50% will not be boiled.

The control part 50 detects that the head temperature exceeds T5° C. based on the detection signal from the temperature sensor 46. The printing pulse signal is outputted to the heating elements 36 to perform a dummy jet N6 times (for example, 3000 times) (step 212). This is because, immediately after stopping the heating operation, the ink temperature is high and the ink viscosity is low so that ink discharge can be done smoothly. Unlike the bubble removing control, since the ink is not boiled, the ink meniscus position is on the ink discharge opening 30 side of the individual channel 32. Ink droplets can be discharged quickly.

Like the bubble removing control, wiping is performed to terminate the control.

The operation of such clogging eliminating control will be described.

In this embodiment, with respect to the thickened ink causing clogging, the short driving pulse signal is inputted to the heating elements 36 for ink discharge. Without increasing the waste ink, the ink in the individual channel 32 and the common liquid chamber 34 can be heated. In addition, no ink droplets are discharged in order to heat the ink. The dummy jet can prevent the nozzle surface 20A of the recording head 20 from being stained.

The head temperature of the recording head 20 is applied to the normal boiling temperature T5° C. by the above heating to perform the dummy jet. The ink whose viscosity is lowered can be preferably discharged from the ink discharge opening 30.

The thickened ink is heated only to the normal boiling temperature T5° C. The thickened ink is not boiled and immediately after reaching the normal boiling temperature, the dummy jet can be performed.

The clogging eliminating control has eliminated clogging using a mechanism in the recording head 20. Head suction maintenance for eliminating the head clogging is unnecessary.

Such an operation is confirmed by test. Table 2 shows the relation between the temperature of the recording head and the recoverability. The evaluated recording head is left for six months in an environment at a constant temperature of 24° C. and a constant humidity of 50%. From the observation of the nozzle surface, meniscus of the ink discharge opening is solidified completely, and the viscosity is increased considerably.

The recording head has a nozzle arrangement of 800 dpi and 512 nozzles in total. Under the ink discharge driving conditions, a driving frequency is 20 kHz, a driving voltage is 32V, a driving current is 100 mA, and the pulse width of a driving pulse is 2.5 μsec.

Under the evaluation conditions, a driving energy of the short pulse signal (1.0 μsec) not discharging ink is applied. After a required head temperature is reached, the normal printing driving pulse signal is applied to perform ink discharge 3000 times. Whether all the nozzles are recovered or not is judged for recoverability. The evaluated ink has the composition of the ink 2.

TABLE 2

Recording head temperature and clogging recoverability

| Recording head temperature | Clogging recoverability |
|---|---|
| 30° C. | No nozzle is recovered. |
| 40° C. | No nozzle is recovered. |
| 50° C. | No nozzle is recovered. |
| 60° C. | No nozzle is recovered. |
| 70° C. | About a half of nozzles are recovered. |
| 80° C. | Several nozzles are not recovered. |
| 90° C. | All nozzles are recovered. |
| 100° C. | All nozzles are recovered. |
| 110° C. | All nozzles are recovered. |

From this result, when the head temperature is raised to about 100° C. as the ink boiling point, the viscosity of the thickened ink is lowered so that the ink can be discharged.

In this embodiment, the recording head is heated by the short pulse signal. The recording head can also be heated by the dummy jet. When the head temperature is increased only by the dummy jet, discharge of about several ten thousands of jets is necessary. The waste ink is increased so that the dummy jet receiving periphery is stained over a wide range. It can be considered preferable that the temperature of the recording head is raised by the short pulse signal not discharging ink, and then the thickened ink is discharged outside by a small number of dummy jets.

The ink jet recording device and the bubble removing method according to the present invention can reliably remove a bubble or clogging by a simplified construction to inhibit image quality deficiency. In addition, only ink discharge permits bubble removal and clogging elimination. A negative-pressure suction device is unnecessary and the waste ink amount can be reduced largely. The ink jet recording device which is at low cost and has high reliability can be provided.

The entire disclosure of Japanese Patent Application No. 2001-154492 filed on May 23, 2001 including specification, claims, drawings and abstract is incorporated herein by reference in its entirety.

What is claimed is:

1. An ink jet recording device comprising:

an ink jet recording head provided with a common liquid chamber to which ink is supplied from outside, individual channels communicated to the common liquid chamber each having an ink discharge opening formed in a front end thereof, heating elements disposed in the individual channels for discharging ink droplets by heating ink, a driving unit for applying a driving energy to the heating elements; and a controller for generating and expanding a bubble in the common liquid chamber by boiling the ink in the common liquid chamber, wherein the controller effects expansion of the bubble to increase a floating force, thereby spacing the bubble from the individual channel to an ink supply side of the common liquid chamber, and subsequently removing the bubble from the common liquid chamber.

2. The ink jet recording device according to claim 1, further comprising a temperature detection unit which detects a temperature of the recording head, wherein in a cleaning mode, the controller signals the driving unit to apply an energy to the heating elements smaller than the energy for discharging ink to increase a temperature of the ink jet recording head until the temperature is a set boiling temperature at least equal to a boiling temperature of the ink in the common liquid chamber, wherein the temperature detection unit detects when the temperature of the recording head reaches the set boiling temperature, wherein thereafter the ink jet recording head is allowed to cool to a set cooling temperature, and wherein when the temperature detection unit detects that the temperature of the recording head is lowered to the set cooling temperature, the controller signals the driving unit to apply an ink discharging energy to the heating elements to perform non-printing ink droplet discharge.

3. The ink jet recording device according to claim 2, further comprising a printed sheet detection unit which detects a number of printed sheets, wherein when the number of printed sheets reaches a predetermined number of sheets, the printed sheet detection unit signals the controller to execute the cleaning mode.

4. The ink jet recording device according to claim 2, further comprising an accumulated discharge detection unit which detects a number of accumulated discharges of ink droplets, wherein when the number of accumulated discharges reaches a predetermined number, the accumulated discharge detection unit signals the controller to execute the cleaning mode.

5. The ink jet recording device according to claim 2, further comprising a head cleaning signal input unit which can input a head cleaning signal to the driving unit, wherein upon input of the head cleaning signal, the controller is signaled to execute the cleaning mode.

6. The ink jet recording device according to claim 1, further comprising a plurality of pillars for stopping the bubble from passing to the individual channels, wherein the pillars are formed on an individual channel side of the common liquid chamber and are spaced at fixed intervals in an arrangement direction of the individual channels, at a fixed distance from the edge of the individual channels.

7. The ink jet recording device according to claim 6, further comprising a path formed in the arrangement direction between the pillars and the common liquid chamber side edge of each one of the individual channels, wherein when the bubble is not attached to the pillars blocking the path, ink is supplied to the individual channels via the path between the pillars.

8. The ink jet recording device according to claim 1, wherein each of the individual channels is formed with an upstream contraction part and a downstream contraction part in which a width of each of the individual channels is narrowed on the common liquid chamber side and the ink discharge opening side, for increasing a bubble point pressure to enhance the energy efficiency at ink droplet discharge.

9. The ink jet recording device according to claim 1, wherein the boiling temperature of the ink is about 100° C.

10. The ink jet recording device according to claim 1, wherein the set boiling temperature is a temperature at which ink refill in the individual channels cannot cover the discharged ink and an ink meniscus position formed in the individual channels is formed on a common liquid chamber side rather than on the heating element due to the continuous ink discharge.

11. The ink jet recording device according to claim 1, wherein a cross-sectional area of a common liquid chamber side edge of the individual channels is smaller than that of a portion where the heating element is disposed.

12. The ink jet recording device according to claim 1, further comprising an ink supply chamber provided adjacent to the common liquid chamber in order to supply ink to the common liquid chamber having a volume in which an expanded bubble can be removed from the common liquid chamber.

13. An ink jet recording device comprising:

a recording head having a common liquid chamber communicated with an outer ink source and with a plurality of ink channels each having a heating element therein; and a driving unit that drives the heating elements, wherein in a cleaning mode, the driving unit applies an energy to the heating elements, smaller than an energy for discharging ink, to boil an ink contained in the common liquid chamber near the ink channels;

a controller for generating and expanding a bubble in the common liquid chamber by boiling ink in the common liquid chamber, wherein the controller effects expansion of the bubble to increase a floating force, thereby spacing the bubble from the individual channel to an ink supply side of the common liquid chamber, and subsequently removing the bubble from the common liquid chamber; and a temperature detection unit that detects a temperature of the recording head, wherein when the temperature detection unit detects that the temperature of the recording head reaches a desired boiling temperature, the driving unit then applies an ink discharging energy to the heating elements to perform non-printing ink droplet discharge.

14. The ink jet recording device according to claim 13, wherein the driving unit is controlled in accordance with an operator's direction.

15. The ink jet recording device according to claim 13, further comprising a maintenance unit that maintains the recording head by vacuuming an ink from the ink channels through an ink discharging portion.

16. The ink jet recording device according to claim 15, further comprising a control unit that independently controls the maintenance unit and the driving unit for independent maintenance movement.

17. A method for removing an undesirable bubble formed between a common liquid chamber and ink channels each having a heating element therein of a recording head, comprising the steps of:

applying an energy to the heating element until an ink near the ink channel in the common liquid chamber generates a bubble;

merging an undesirable bubble and the generated bubble for forming a larger bubble having a relatively large buoyancy in the common liquid chamber;

discontinuing the energy applied to the heating element so that the ink is cooled and the buoyancy of the larger bubble increases; and removing the larger bubble through the common ink chamber due to the buoyancy.

18. An ink jet recording device comprising:

an ink jet recording head provided with a common liquid chamber to which ink is supplied from outside;

individual channels communicated to the common liquid chamber, each having an ink discharge opening formed in a front end thereof, heating elements disposed in the individual channels for discharging ink droplets by heating ink;

a driving unit for applying a driving energy to the heating elements until ink present in the common liquid chamber is boiled and expanding a bubble in the common liquid chamber; and a temperature detection unit which detects a temperature of the recording head, wherein the temperature detection unit detects that the temperature of the recording head reaches a set boiling temperature, whereby the driving unit stops applying the driving energy to the heating elements, wherein the set boiling temperature is a temperature at which ink refill in the individual channel cannot cover the discharged ink and an ink meniscus position formed in the individual channels is formed on a common liquid chamber side rather than on the heating element due to the continuous ink discharge.

* * * * *